US011697892B2

(12) United States Patent
Martens et al.

(10) Patent No.: US 11,697,892 B2
(45) Date of Patent: Jul. 11, 2023

(54) DEVICE AND METHOD FOR PRODUCING POLYMER FIBERS AND ITS USES THEREOF

(71) Applicant: Gelatex Technologies OÜ, Tallinn (EE)

(72) Inventors: Märt-Erik Martens, Tallinn (EE); Raido Enn, Järveküla (EE); Sander Õun, Kuressaare (EE); Markus Veinla, Tartu (EE); Karl Marti Toots, Tartu (EE); Martin Järvekülg, Tartu (EE)

(73) Assignee: Gelatex Technologies OÜ, Tallinn (EE)

( * ) Notice: Subject to any disclaimer, the term of this patent is extended or adjusted under 35 U.S.C. 154(b) by 0 days.

(21) Appl. No.: 17/394,620

(22) Filed: Aug. 5, 2021

(65) Prior Publication Data

US 2022/0049376 A1 Feb. 17, 2022

(30) Foreign Application Priority Data

Aug. 13, 2020 (EP) ..... 20190897

(51) Int. Cl.
*D01D 5/24* (2006.01)
*D01D 5/06* (2006.01)
*D01D 13/02* (2006.01)

(52) U.S. Cl.
CPC ..... *D01D 5/24* (2013.01); *D01D 5/06* (2013.01); *D01D 13/02* (2013.01)

(58) Field of Classification Search
CPC ..... D01D 5/06; D01D 5/24; D01D 13/02
See application file for complete search history.

(56) References Cited

U.S. PATENT DOCUMENTS 2,065,124 A * 12/1936 Dreyfus et al. ..... D01F 2/30 425/76
2,866,256 A * 12/1958 Matlin ..... D01D 5/20 428/401

(Continued)

FOREIGN PATENT DOCUMENTS

CN 110325674 A 10/2019
DE 10313877 A1 † 10/2003

OTHER PUBLICATIONS

European Patent Office, Extended European search report, application No. 20190897.7, dated Jan. 19, 2021, 7 pages.

(Continued)

*Primary Examiner* — Emmanuel S Luk
(74) *Attorney, Agent, or Firm* — Ziegler IP Law Group, LLC

(57) ABSTRACT

A device including one or more nozzles having a tubular fiber spinning needle and method for producing non-toxic polymer fibers and microfibrous and nanofibrous polymer materials made thereof on a small to large scale using a wide range of synthetic polymers and bio-based polymers. The device and method enable continuous in-line production of polymer fibers at a high fiber production rate energy efficiently and safely. The increased polymer fiber production rate is achieved by the at least one nozzle that enables a centrifugal force acting upon the tubular fiber spinning needle causing rotational motion of the tubular fiber spinning needle and higher polymer injection rates per nozzle.

11 Claims, 7 Drawing Sheets

(56) References Cited

U.S. PATENT DOCUMENTS 2,932,079 A * 4/1960 Dietzsch ..... D01D 5/30 428/397
2,974,070 A * 3/1961 Van Dongeren ..... B08B 3/12 134/1
3,015,873 A * 1/1962 Dietzsch ..... D01D 5/34 428/398
3,543,332 A * 12/1970 Roberts ..... D01D 5/0985 264/211.14
3,920,362 A * 11/1975 Bradt ..... D01D 5/00 425/7
4,135,903 A * 1/1979 Ohsato ..... C03B 37/06 65/528
4,416,600 A * 11/1983 Lecznar ..... B22F 9/082 425/10
4,826,415 A * 5/1989 Mende ..... D01D 4/025 425/7
5,622,671 A * 4/1997 Pellegrin ..... D01D 5/18 264/211.1
5,674,307 A * 10/1997 Huey ..... D01D 5/24 65/459
8,641,960 B1 2/2014 Medeiros et al.
9,775,694 B2 * 10/2017 Tutak ..... D01D 5/14
2003/0183978 A1 † 10/2003 Asakura
2005/0056956 A1 * 3/2005 Zhao ..... D04H 18/04 264/180
2007/0299236 A1 * 12/2007 Kim ..... C08G 63/08 528/272
2008/0048356 A1 * 2/2008 Kitayama ..... B29C 48/32 425/577
2009/0297822 A1 * 12/2009 Fujimura ..... B01D 69/088 428/314.2
2010/0311943 A1 * 12/2010 Lallave Rivas ..... D01F 9/00 528/487
2011/0154627 A1 * 6/2011 Chou ..... D01F 2/00 28/107
2011/0285065 A1 * 11/2011 Koyama ..... D01D 5/0985 425/72.2
2012/0240369 A1 9/2012 Mattoso et al.
2013/0040140 A1 * 2/2013 Joo ..... B29C 48/05 428/401
2013/0292860 A1 * 11/2013 Fujiki ..... D01D 4/02 264/13
2014/0170256 A1 * 6/2014 Tai ..... D01D 5/24 425/461
2014/0264985 A1 † 9/2014 Sutti
2015/0017862 A1 1/2015 Hassingboe et al.
2015/0322592 A1 11/2015 Brown et al.
2016/0325480 A1 * 11/2016 Soletti ..... A61F 2/06
2017/0348644 A1 * 12/2017 Mizuta ..... B01D 67/0016
2018/0044817 A1 * 2/2018 Ben Dror ..... D01F 8/00
2019/0233972 A1 * 8/2019 Choi ..... B01D 69/085
2020/0216981 A1 * 7/2020 Ichibayashi ..... D02J 1/224
2022/0195629 A1 * 6/2022 Wu ..... D01D 5/24

OTHER PUBLICATIONS

China National Intellectual Property Administration, First Office Action, Application No. 202110821248.4, dated Sep. 14, 2022, 13 pages.

* cited by examiner
† cited by third party

DEVICE AND METHOD FOR PRODUCING POLYMER FIBERS AND ITS USES THEREOF

TECHNICAL FIELD

The aspects of the disclosed embodiments relate generally to polymeric fiber production, more specifically, to a device and method for producing polymer fibers based on a polymer solution-based spinning technology and non-woven polymeric materials based on the polymer fibers.

BACKGROUND

A need for fibrous products made from a wide variety of polymers to suit various customer end-use needs is increasing. Hence, polymeric fine fiber structures are increasingly being investigated for use in various applications like textile materials, medical prostheses, construction materials, reinforcement materials, and absorbent materials due to their large specific surface area. Most non-woven micro- or nano-fiber webs are produced by electrospinning, melt spinning, melt blowing or blow spinning. Electrospinning is a charge-induced spinning method for producing nanofibers. Besides the slow fiber production rate (i.e. mass of fibers produced per unit of time), an additional disadvantage of electrospinning is that the collected material must be conductive, in order to not lead to charge build upon the material. The electrospinning requires high voltage, which makes this technology dangerous. Thus, more safer solutions are needed. Additionally, the solvents used in electrospinning must be conductive to at least some degree, thus limiting the range of possible solvents. Melt blowing and melt spinning enables industrial or commercial-scale manufacture of nanofibrous materials with a production rate ranging from about a few hundred kilograms to about several tons per 24 hours, thus requiring a much higher capital investment. Both melt blowing and melt spinning requires the polymer to be melted prior to the spinning procedure. This limits the number of polymers that can be spun, since many polymers, especially those of biological origin, cannot be melted, as they break down before melting. Further, melt blowing and melt spinning are also limited by the viscosity of the melted polymer which must be low enough for the polymer melt to be extrudable and for the airflow to be capable of drawing the polymer melt into fiber form. A solution blow spinning technique was developed using elements of both electrospinning and melt blowing technologies as an alternative method for making non-woven webs of micro and nanofibers with diameters comparable with those made by the electrospinning process. The blow spinning method has a slow solution flow, which results in low fiber production.

Existing devices and methods that attempt to produce polymeric micro-fibrous or nanofibrous materials have a low fiber production rate. Further, with known methods, it is difficult to achieve the full potential of microfibers and nanofibers because of limited options for mass-production. Demand for bio-based and eco-friendly microfibers and nanofibers are growing, but there is currently no fast and cost-effective method to produce bio-based microfibers and nanofibers on a large scale. Currently, known methods are either expensive or slow further limited only to some polymers and solvents. Therefore, there is a need to address the aforementioned technical drawbacks in existing technologies to produce polymer fibers at a higher fiber production rate with inexpensive and simple machinery requirements using a wide range of polymers.

SUMMARY

The present disclosure seeks to provide an efficient device and method for producing polymer fibers continuously with inexpensive and simple machinery requirements using a wide range of polymers (e.g. synthetic polymers, bio-based polymers, etc.). An aim of the present disclosure is to provide a solution that overcomes at least partially the problems encountered in prior art and provide improved methods and systems for producing synthetic polymer fibers and bio-based polymer fibers with higher fiber production rate and which does not require precision engineered parts that have low manufacturing tolerances nor the use of toxic chemicals. The object of the present disclosure is achieved by the solutions provided in the enclosed independent claims. Advantageous implementations of the present disclosure are further defined in the dependent claims.

According to a first aspect, the present disclosure provides a device for producing polymer fibers, the device comprising: at least one nozzle configured to receive a polymer solution and a jet of compressed gas, wherein the at least one nozzle comprises a body having a hollow space, an opened first end and a second end opposite to the opened first end, a first inlet of the jet of compressed gas in the second end, and at least one tubular fiber spinning needle being mounted through the second end and the hollow space, wherein the at least one tubular fiber spinning needle comprises an unfixed distal end protruding from the opened first end, a proximal end opposite to the unfixed distal end, an inlet of the polymer solution at the proximal end, and an outlet of the polymer solution at the unfixed distal end, wherein the proximal end of the at least one tubular fiber spinning needle is fixed to the second end of the at least one nozzle; a pump configured to pump the polymer solution through the at least one tubular fiber spinning needle of the at least one nozzle; a gas compressor configured to direct the jet of compressed gas into the first inlet of the jet of compressed gas of the at least one nozzle; and a first moving means of the unfixed distal end of the at least one tubular fiber spinning needle.

The device according to the present disclosure enables continuous in-line production of polymer fibers at a high fiber production rate with inexpensive and simple machinery requirements; to use a wide range of polymers (e.g. synthetic polymers, bio-based polymers) and solvents to be used for polymer fiber production, is energy efficient as it does not require high voltage. The polymer fibers produced by the present device are non-toxic as the device enables after polymer fiber formulation to evaporate all the solvent, and thus enables to obtain non-toxic polymer fibers. The increased production rate compared to conventional solutions is achieved by the at least one nozzle that enables a centrifugal force acting upon the tubular fiber spinning needle causing rotational motion of the tubular fiber spinning needle and more than ten times higher polymer injection rates per nozzle than the known technologies. The rotating motion of the tubular fiber spinning needle breaks the polymer solution jet into droplets. The droplets are then accelerated and elongated in the airflow, resulting in a fiber forming from each droplet. Such a device configuration enables to form fibers faster than known devices, and thus providing higher production rates. Additionally, in different embodiments the device enables to implement more than one nozzle, which allows to form several fibers at the same time, giving rise to even higher fiber production rate in comparison to devices where only one fiber at a time is formed from a single nozzle.

According to a second aspect, there is provided a method for producing polymer fibers, the method comprising: pumping a polymer solution into at least one nozzle through an inlet of the polymer solution of at least one tubular fiber spinning needle of the at least one nozzle; delivering a jet of compressed gas into the at least one nozzle through a first inlet of compressed gas; applying movement to the at least one tubular fiber spinning needle by the delivered jet of compressed gas; forming a droplet of the polymer solution to a tip of a distal end of the at least one tubular fiber spinning needle; and obtaining a polymer fiber from the formed droplet, wherein a diameter of the polymer fiber is 0.2-10 micrometers, more specifically 0.1-10 micrometers.

The method according to present disclosure enables to increase the fiber production rate by continuous in-line production and achieve polymer fibers with a unique morphology resulting in a large specific surface area. By applying the movement, e.g. vibration, to the tubular fiber spinning needle, the vibrating tubular fiber spinning needle ensures that the polymer doesn't precipitate out of the polymer solution at the tip of the tubular fiber spinning needle. The method enables to use both synthetic and bio-based polymers for producing polymer fibers which provide more possibilities to produce different types of polymeric nanofiber webs for different type of materials and applications. An additional advantage of the method according to the present disclosure is that the method enables to produce microfibrous and nanofibrous materials on a small to large scale (i.e. between the lab scale production and mass scale production). The embodiments of the present disclosure do not require polymers to be melted that are used in the polymer fibers producing process. Thus, it is possible to spin fibers also from bio-based polymers many of which do not tolerate high temperatures. The method enables much greater polymer fiber production rates than currently existing technologies.

E.g., using bio-based polymers provides several significant effects. Materials made from bio-based polymers are biodegradable and biosorbable. Since bio-based polymers generally do not melt, their only formulation is to dissolve them in a solvent. A great advantage in the production of e.g. gelatin fibers is that it enables to use water as a solvent. Thus, no toxic chemicals are used in the manufacture of gelatin fibers. If used with other types of solvents, the method according to the present disclosure enables to evaporate all the solvent, and thus enables to obtain non-toxic polymer fibers. The materials made of non-toxic polymer fibers are required e.g. in the medical field. Further, bio-based polymers are important for several additional reasons. The bio-based polymers provide a solution to the increasing amount of non-biodegradable plastic waste in the world. Differently from many synthetic polymers, bio-based polymers are not derived from non-renewable resources. Thirdly one major field of use for bio-based polymers is the medical field where it can be advantageous for used materials to decompose in the body after completing their task. Biodegradability is a key aspect for such cases.

According to a third aspect, there is provided a polymer solution for producing polymer fibers comprising at least one polymer dissolved in at least one solvent, including a concentration of the at least one polymer is 9%-45% by weight of the at least one solvent, and a viscosity of the polymer solution is 1 millipascal-second-5000 pascal-second. The embodiments of the polymer solution, device and method according to the present disclosure enable to produce polymer fibers in both, micro and nano scale. By varying the method parameters, it is possible to produce either only nano fibers, only micro fibers or partly in both micro and nano areas at the same time. Which option is realized depends on the specific material and combination of conditions. Moreover, the further advantage of the polymer solution for producing the polymer fibers is that the components of the polymer solution can be evaporated, thus the obtained polymer fibers do not include any toxic chemicals.

According to a fourth aspect, there is provided a material comprising polymer fibers produced by the present method, which is used for making a non-woven filter material, a leather-like textile, a biomaterial for bone regrowth, a wound care material, a 3D scaffold for cell cultivation and tissue engineering, an electrode material for capacitors, ceramic nanofibers (e.g., Al2O3 nanofibers), cell-cultured meat. The advantage of the materials produced from the polymer fibers according to the present disclosure is that the materials comprising polymer fibers are airy and fluffy having nanofibrous twisted ribbon type mesh morphology. The polymer fiber based materials have also better tensile strength and better mechanical properties than the conventional spinning technologies enable.

Embodiments of the present disclosure eliminate the aforementioned drawbacks in existing known approaches for producing polymer fibers. The advantage of the embodiments according to the present disclosure is that the embodiments enable continuous in-line production of polymer fibers at a higher production rate with inexpensive and simple machinery requirements. The embodiments are compatible with a wide range of synthetic polymers, bio-based polymers and solvents to be used for polymer fiber production. The present embodiments are energy efficient as do not require high voltage. Additional aspects, advantages, features and objects of the present disclosure are made apparent from the drawings and the detailed description of the illustrative embodiments construed in conjunction with the appended claims that follow. It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. To illustrate the present disclosure, exemplary constructions of the disclosure are shown in the drawings. However, the present disclosure is not limited to specific methods and instrumentalities disclosed herein. Moreover, those in the art will understand that the drawings are not to scale. Wherever possible, the same elements have been indicated by identical numbers. Embodiments of the present disclosure will now be described, by way of example only, with reference to the following diagrams wherein:

FIG. 3D is a schematic illustration of a cross-sectional view B-B of the nozzle of FIG. 2*b* having a conical body and conical hollow space in accordance with an embodiment of the present disclosure;

DETAILED DESCRIPTION OF EMBODIMENTS

Figure 1:
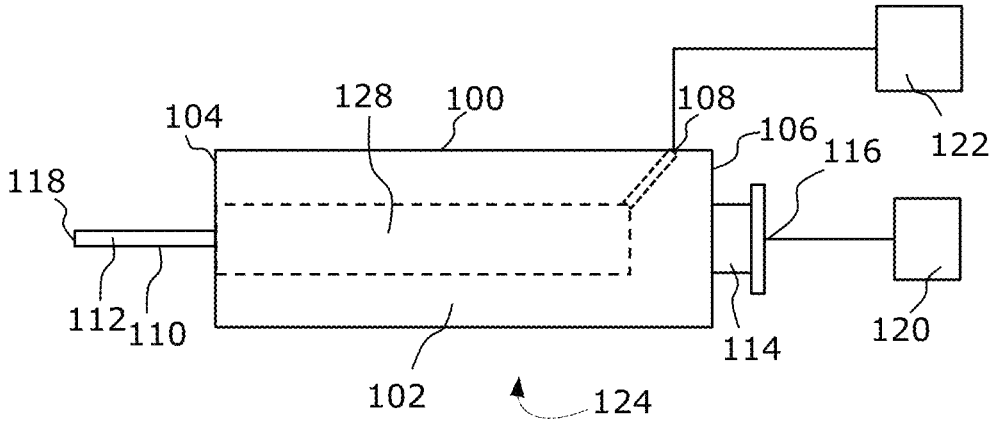
FIG. 1 is a schematic illustration of a device for producing polymer fibers in accordance with the embodiments of the present disclosure.

The following detailed description illustrates embodiments of the present disclosure and ways in which they can be implemented. Although some modes of carrying out the present disclosure have been disclosed, those skilled in the art would recognize that other embodiments for carrying out or practicing the present disclosure are also possible.

According to a first aspect, there is provided a device for producing polymer fibers, the device comprising: at least one nozzle configured to receive a polymer solution and a jet of compressed gas, wherein the at least one nozzle comprises a body having a hollow space, an opened first end and a second end opposite to the opened first end, a first inlet of the jet of compressed gas in the second end, and at least one tubular fiber spinning needle being mounted through the second end and the hollow space, wherein the at least one tubular fiber spinning needle comprises an unfixed distal end protruding from the opened first end, a proximal end opposite to the unfixed distal end, and an inlet of the polymer solution at the proximal end, an outlet of the polymer solution at the unfixed distal end and wherein the proximal end of the at least one tubular fiber spinning needle is fixed to the second end of the at least one nozzle; a pump configured to pump the polymer solution through the at least one tubular fiber spinning needle of the at least one nozzle; a gas compressor configured to direct the jet of compressed gas into the first inlet of the jet of compressed gas of the at least one nozzle; and a first moving means of the unfixed distal end of the at least one tubular fiber spinning needle.

The advantage of the embodiment is that it enables continuous in-line production of polymer fibers at a high production rate with inexpensive and simple machinery requirements. The device according to the present embodiment enables to use a wide range of polymers (e.g. synthetic polymers, bio-based polymers, etc.) and solvents to be used for polymer fiber production. The device is energy efficient as it does not require high voltage. Moreover, the device facilitates the use of the polymers having low temperature tolerances and the use of the said polymers dissolved in a solvent for producing the polymer fibers. Therefore melting of the polymers is not required for producing the polymer fibers.

The device thus enables the production of polymer fibers from the polymer solution more efficiently with increased polymer fiber production rate. In the embodiments of the present disclosure the jet of compressed gas causing a torque acting upon the at least one tubular fiber spinning needle. The term "at least one tubular fiber spinning needle" used herein refers to the one or more tubular fiber spinning needles of the embodiments of the present disclosure and used throughout the present disclosure hereinafter as tubular fiber spinning needle. According to an embodiment of the present disclosure, the tubular fiber spinning needle may be a syringe needle type arrangement. The torque applied by the spinning air vortex in turn causes the vibrational movement of the tubular fiber spinning needle. This causes a vibratory effect on the unfixed distal end of the tubular fiber spinning needle, which helps to prevent the precipitation of the polymer solution at the tip of the tubular fiber spinning needle.

The device further provides a solution to the increasing amount of non-biodegradable plastic waste as it enables to produce the polymer fibers from renewable resources (e.g. bio-based polymers such as gelatin, collagen, etc.). The device further enables the production of both microfiber and nanofiber including distribution of diameters of the fibers partly in both micro- and nano-areas at the same time. Additionally, the device enables the production of the polymer fibers on a small scale, a medium scale and on a large scale with a high fiber production rate and a cheaper production cost.

The jet of compressed gas is delivered to the hollow space of the nozzle through the first inlet of the compressed gas. According to the embodiments of the present disclosure, the nozzle may have e.g. cylindrical or conical external shape. The conical shape of the nozzle enables the gas flow of the jet of compressed gas to exit from the nozzle to get additional air from the sides of the nozzle using the Venturi effect. The Venturi effect is the reduction in pressure that results when the jet of compressed gas flows through the nozzle that is conical in shape. Additionally, the external conical shape enables to save material.

The inlet of the compressed gas is formed offset from the nozzle axis and formed through the nozzle body so that the distal edge of the hollow space of the nozzle and the edge of the first inlet of the compressed gas is tangential, i.e. aligned. This is necessary to create a rotating vortex of the jet of compressed gas. The jet of compressed gas exits from the opened first end of the nozzle. When directed into the hollow space of the nozzle the jet of compressed gas moves towards the of the opened first end of the nozzle and pulls the polymer solution out of the tubular fiber spinning needle and is initiated to move in a circular motion around the polymer solution at the unfixed distal end of the tubular fiber spinning needle. The combination of the forward movement and the circular movement of the jet of compressed gas causes the helical trajectory (e.g. a spiral movement) of the jet of the compressed gas, which in turn causes the unfixed distal end of the tubular fiber spinning needle to revolve (i.e. rotational movement) or vibrate. This rotational or vibrational movement of the unfixed distal end of the tubular fiber spinning needle creates a centrifugal force which is acting on the polymer solution and breaks the polymer solution at the outlet of the polymer solution into polymer solution droplets. The polymer fibers are formed from the polymer solution droplets when the polymer solution droplets are accelerated and elongated in the gas flow provided by the jet of compressed gas. The polymer fibers during the formation are stretched out by the jet of compressed gas.

The polymer fibers may continue to grow due to the rotational or the vibrational movement of the unfixed distal end until the jet of compressed gas separates the polymer fibers from the polymer solution droplet. The centrifugal force acting on the polymer solution improves the morphology of the polymer fibers as it helps to make the polymer fibers airy or fluffy which performs better than other dense materials.

The hollow space of the nozzle provides a space for the tubular fiber spinning needle and to vibrate or to rotate the unfixed distal end of the tubular fiber spinning needle. The hollow space defines a radius of rotational or vibrational movement of the unfixed distal end of the tubular fiber spinning needle.

The jet of compressed gas may be heated before directed into the hollow space of the nozzle to warm up the nozzle assembly. This improves the solubility and lowers the viscosity of the polymer solution. Another benefit of the heated compressed air is lessening the effect of cooling when gas expands to atmospheric pressure. The vibrational movement of the tubular fiber spinning needle ensures that the polymer does not precipitate out of the polymer solution at the unfixed distal end of the tubular fiber spinning needle.

In an embodiment, the opened first end of the at least one nozzle and the unfixed distal end of the tubular fiber spinning needle are simultaneously moved due to the rotational or the vibrational movement generated by the first moving means to exert a centrifugal force, which is then acted on the polymer solution present in the at least one nozzle to produce the polymer solution droplets. In some embodiments, either the rotational or the vibrational movement of the unfixed distal end of the tubular fiber spinning needle may be sufficient to exert the centrifugal force on the polymer solution present in the at least one nozzle to produce the polymer solution droplets. The first moving means may generate a movement of the unfixed distal end of the tubular fiber spinning needle that includes at least one of a rotational, a vibrational, a revolving, a circular movement or a combination of different types of movements.

The revolving movement of the opened first end of the at least one nozzle and the rotational or the vibrational movement of the unfixed distal end of the tubular fiber spinning needle may be generated by the jet of compressed gas that moves in the helical trajectory to exert the centrifugal force on the polymer solution present in the at least one nozzle. The device may include an additional centrifugal force component that acts on the polymer solution. This additional centrifugal force may further improve the morphology polymer fiber that is produced and the fiber production rate of the device. The centrifugal force acting on the polymer solution exiting from the at least one nozzle at the unfixed distal end of the tubular fiber spinning needle breaks the polymer solution on the tip of the distal end into a droplet, which vibrates circularly together with the distal end of the tubular fiber spinning needle.

The tubular fiber spinning needle is optionally mounted through the second end and the hollow space of the at least one nozzle in various geometrical configurations. The tubular fiber spinning needle may be mounted through the second end and the hollow space of the at least one nozzle in a circular configuration. The tubular fiber spinning needle is optionally mounted through the second end and the hollow space of the at least one nozzle in a stacked configuration.

The device may produce at least one of microfibers and nanofibers. The present device may produce at least one of nanofibers and microfibers by varying process parameters. The process parameters may vary according to the condition and may be selected from at least one of an injection rate of the polymer solution, a pressure of the polymer solution being injected, a pressure of the jet of compressed gas and a rate of polymer fiber production. The device enables the distribution of polymer fiber production in at least one of micro-area or nano-area based on a specific type of polymer used for the production along with a combination of operating conditions. The operating conditions of the device may include a temperature of the jet of compressed gas. The device may include a control unit for controlling the operations of at least one of the pumps, the gas compressor, and the mechanical or electromechanical device.

In an embodiment, the rate of the polymer fiber production of the device is 1-1.5 kg/hour. The polymer fiber production at this rate improves the morphology of the polymer fibers which performs better than other dense polymer materials. The rate of the polymer fiber production can be from 1, 1.1, 1.2, 1.3 or 1.4 kg/hour up to 1.1, 1.2, 1.3, 1.4 or 1.5 kg/hour. E.g., a rate of the polymer fiber production of the device is 21 grams per nozzle orifice per hour. The polymer fibers production at this rate improves the morphology of the polymer fiber that is formed and also helps in the large-scale production of the polymer fibers. The rate of the polymer fiber production may be e.g. 12, 13, 14, 15, 16, 17, 18, 19, 20, 21, 22, 23, 24, 25, 26 or 28 grams per nozzle per hour.

According to the embodiments of the present disclosure, the cross-section of the obtained polymer fibers may be oval, dumbbell or circular in a smaller extent of the fiber. The oval cross section of the polymer fiber provides the polymer fiber a flat tape-like appearance. The dumbbell cross section provides the polymer fiber a flat tape-like appearance. During the spinning process, the portion of the polymer fiber may first become solid on the surface of the polymer solution and generate a structure with an empty polymer cylinder inside. The empty polymer cylinder structure that is formed inside the polymer fiber may collapse and generate the oval or dumbbell cross section. The cross-section of the polymer fiber may have a structure resembling a helix due to the twisting of the polymer fibers that are caused by the rotational movement of the polymer fibers during the fiber forming process.

According to an embodiment, the device further comprises two or more nozzles and a spinneret comprising a hollow body having a second inlet of the jet of compressed gas, wherein the two or more nozzles are connected to the hollow body by the second end and wherein the gas compressor is configured to direct the jet of compressed gas into the hollow body of the spinneret through the second inlet of the jet of compressed gas and through the hollow body to the first inlet of the jet of compressed gas of the each nozzle of two or more nozzles. In the embodiment, the device comprises the spinneret comprising two or more nozzles or wherein the two or more nozzles are connected to the spinneret, wherein each of the nozzles has a tubular fiber spinning needle for forming polymer fibers. The two or more nozzles attached to the spinneret may be e.g. cylindrical nozzles or conical nozzles. The spinneret is configured to perform a spinning process for producing the polymer fibers.

According to an embodiment, the device may further comprise two or more spinnerets that are attached together to form a set, wherein each of the spinnerets comprises two or more nozzles. Such embodiments allow to stack multiple spinnerets on top of each other, in a row or in other configurations, which enables to multiply the fiber production rate.

The tubular fiber spinning needle may be fixed to the hollow body of the spinneret. When the tubular fiber spinning needle vibrates due to the vibrational movement caused by the jet of compressed gas, the spinneret may be also configured to vibrate to ensure that the polymer solution does not precipitate out of the polymer solution at the unfixed distal end of the tubular fiber spinning needle.

According to the embodiments, the hollow body of the spinneret may have triangular, flat triangular, circular or pyramid shape, wherein each spinneret may comprise one or more nozzles protruding from the hollow body of the spinneret and one or more second inlets of the jet of compressed gas. In an example, each spinneret may include a circular hollow body with at least four nozzles protruding from the circular hollow body and at least four second inlets of the jet of compressed gas.

According to the embodiment, the polymer solution is pumped into the spinneret through the two or more nozzles that are connected to the hollow body of the spinneret. The polymer solution may be heated before entering through the two or more nozzles. The jet of compressed gas that is directed into the hollow body of the spinneret through the second inlet of the jet of compressed gas and through the first inlet of the jet of compressed gas of each of the two or more nozzles may be heated before entering the hollow body of the spinneret. The jet of compressed gas may be heated to lessen the cooling effect from decompression. The jet of compressed gas is delivered through the two or more nozzles such that the gas flow of the jet of compressed gas at the opened first end of each of the two or more nozzles includes a component parallel to the direction of a flow of the polymer solution and a component that is tangential to the surface of the polymer solution jet and perpendicular to the direction of the flow of the polymer solution. This causes the tubular fiber spinning needle to vibrate and the vibrational movement of the tubular fiber spinning needle creates a centrifugal force which is acting on the polymer solution and breaks the polymer solution into polymer solution droplets for producing the polymer fibers.

The polymer solution is directed into the each tubular fiber spinning needle provided inside the two or more nozzles through the inlet of the polymer solution. The inlet of polymer solution may be optionally arranged on an inlet housing. The inlet housing is configured to receive the polymer solution from a second inlet of polymer solution and further configured to direct the polymer solution into the inlet of the polymer solution.

The device optionally includes a frame on which the two or more nozzles or the two or more spinnerets are attached and is configured to move the two or more nozzles or the two or more spinnerets by means of a mechanical or electromechanical device. The two or more nozzles or the two or more spinnerets may be attached in a horizontal orientation on the frame, in a vertical orientation on the fixed frame. The two or more nozzles or the two or more spinnerets may be connected to the frame in a manner that the two or more nozzles or the two or more spinnerets are moveable on the fixed frame in a backward and forward direction, in an upward and downward direction to deposit the polymer fiber on the air permeable fiber collection surface. The two or more nozzles of the spinneret may be configured to rotate while moving on the frame in the upward and downward direction to deposit the polymer fiber on the surface of the air permeable fiber collection surface.

According to an embodiment, the first moving means of the unfixed distal end of the at least one tubular fiber spinning needle is selected from a group comprising a mechanical or electromechanical device moving the unfixed distal end of the at least one tubular fiber spinning needle, a mechanical or electromechanical device vibrating the at least one nozzle and the first moving means formed by the first inlet of the jet of compressed gas in the second end of the at least one nozzle. The first moving means may generate a rotational, a vibrational, a revolving, a circular movement or combination of different types of movements of the nozzle or the unfixed distal end of the tubular fiber spinning needle in the opened first end of the nozzle by the jet of compressed gas moving in the helical trajectory. The rotational, vibrational, revolving, circular movement or combination of different types of movements of the tubular fiber spinning needle may be initiated by moving the unfixed distal end using by the mechanical or electromechanical device attached to the nozzle, spinneret or providing a vibration directly to the tubular fiber spinning needle. The rotational, vibrational, revolving, circular movement or combination of different types of movements of the tubular fiber spinning needle may be achieved by the second end of the tubular fiber spinning needle fixed through the hollow space of the nozzle to the spinneret, wherein the spinneret is configured to transmit the said movements to the tubular fiber spinning needle by the mechanical or electromechanical device.

According to an embodiment, the device further comprises a collection unit for collecting the polymer fibers, wherein the collection unit comprises an air permeable fiber collection surface and a suction unit configured to draw an air through the air permeable fiber collection surface and to produce a suction pressure for depositing the polymer fibers on the air permeable fiber collection surface. In an embodiment, the collection unit is placed at a distance from 0.3, 0.4, 0.5, 0.6, 0.7, 0.8, 0.9, 1.1, 1.2, 1.3, 1.4, 1.5, 1.6, 1.7, 1.8 or 1.9 meters up to 0.4, 0.5, 0.6, 0.7, 0.8, 0.9, 1, 1.1, 1.2, 1.3, 1.4, 1.5, 1.6, 1.7, 1.8, 1.9 or 2 meters away from the at least one nozzle or the at least one spinneret, and wherein the suction pressure is at least 10 Pascals below ambient pressure. The air permeable fiber collection surface may function as a substrate material for the polymer fiber material. The air permeable fiber collection surface may comprise an air permeable fiber collection material (e.g. textile) attached to the air permeable fiber collection surface for collecting the obtained polymer fibers. The air permeable fiber collection surface may move in a direction perpendicular to the spinning direction of the at least one nozzle or the at least one spinneret. A thickness of the polymer fiber material is controlled by varying a speed at which the air permeable fiber collection surface moves. The suction unit may draw air through the air permeable fiber collection surface. The jet of compressed gas that flows along with the at least one nozzle enables the moving of the polymer fiber onto the air permeable fiber collection surface. The jet of compressed gas may flow through the collected polymer fiber material thereby drying it of any solvent vapors that may remain in the polymer fiber material. A rate of the evaporation of solvent from the polymer fibers may be increased by drawing the jet of compressed gas through the polymer fiber material. The jet of compressed gas that is drawn into the polymer fiber material may guide airborne polymer fibers onto the air permeable fiber collection surface and produce an additional force with which the polymer fibers become attached to each other on the air permeable fiber collection surface to form the polymer fiber material.

Additionally, the collection unit may include one or more rollers on a downstream side of the collection unit that enables to move the air permeable fiber collection surface in a direction that is perpendicular to the direction of the spinning of the at least one nozzle. The collection unit may additionally include a wind-up roller to which the polymer fiber material is directed to and wound over onto the wind-up roller. The one or more rollers and wind-up roller may be e.g. cylindrical rollers. The wind-up roller may have a roll width of up to 1.2 meters, more than 1.2 meters or may have a customizable roll width.

According to an embodiment, the air permeable fiber collection surface further comprises an air permeable fiber collection material. The air permeable fiber collection material facilitates to collect the obtained polymer fibers. The air permeable fiber collection material may be selected from a variety of porous materials including spun-bonded nonwovens, needle punched nonwovens, woven fabrics, knit fabrics, apertured films, paper or combinations thereof.

According to an embodiment, the collection unit further comprises a heating and solvent evaporation chamber and the air permeable fiber collection surface is a movable air permeable fiber collection surface. The heating and the solvent evaporation chamber may be provided with a heating unit. The obtained polymer fibers collected on to the air permeable fiber collection surface are directed to the heating and the solvent evaporation chamber to evaporate the solvent more quickly. The obtained polymer fibers may be directed to the heating and the solvent evaporation chamber depends on the solvent that is used and the further use of the formed polymer fibers. The collection unit further may comprise a heating chamber to which the obtained polymer fibers are directed to for heating the polymer fibers, which is then further directed to the collection unit. If the removal of the solvent is not critical, the polymer fibers that are formed may be directly guided to the collection unit bypassing the heating and solvent evaporation chamber. The movable air permeable fiber collection surface enables the obtained polymer fibers to direct to the collection or to solvent evaporation. The movable air permeable fiber collection surface may be e.g. an air permeable conveyor, a continuous collector belt or manually removable collection surface. E.g., the polymer fiber material may be collected on a continuous collector belt and to evaporate the solvent from the obtained polymer fibers collected on to the continuous collector belt may be pulled through a solvent evaporation section, wherein the solvent is evaporated by using e.g. a fan or heating.

According to an embodiment, a diameter of the at least one nozzle is 1.5 mm-5.0 mm and a diameter of the at least one tubular fiber spinning needle is 0.6 mm -1.6 mm. The diameter of the nozzle 1.5-5 mm provides enough space for the hollow space in the opened first end of the nozzle, and thus enough space for the tubular fiber spinning needle to rotate or to vibrate. If the diameter is too small it does not leave enough room at the opened first end of the nozzle for the distal end of tubular spinning forming needle to vibrate or rotate in hollow space of the nozzle. If the diameter is too big it does not let enough pressure to build up in the hollow space. The diameter of the nozzle can be from 1.5, 2, 2.5, 3, 3.5, 4 or 4.5 mm up to 2, 2.5, 3, 3.5, 4, 4.5 or 5 mm. A diameter of the tubular fiber spinning needle may be 0.6-1.6 mm. The tubular fiber spinning needle having a bigger diameter doesn't vibrate or rotate sufficiently, the tubular fiber spinning needle having a smaller diameter does not let enough polymer solution through. The diameter of the tubular fiber spinning needle can thus be from 0.6, 0.7, 0.8, 0.9, 1.0, 1.1, 1.2, 1.3, 1.4 or 1.5 mm up to 0.7, 0.8, 0.9, 1.0, 1.1, 1.2, 1.3, 1.4, 1.6 mm. In an embodiment, the preferred diameter of the nozzle is 3 mm and the preferred diameter of the tubular fiber spinning needle is 0.8 mm, which provides the best fiber forming results.

According to an embodiment, the device further comprises a second moving means of the at least one nozzle to apply at least one movement to the at least one nozzle, wherein the at least one movement is selected from rotating the at least one nozzle, moving the at least one nozzle left and right, and moving the at least one nozzle up and down with respect to the air permeable fiber collection surface. In such embodiments, the second moving means is configured to move the at least one nozzle to provide to the vibrating tubular fiber spinning needle additional movements to enable the forming polymer fiber more effectively to be elongated, stretched out and finally to separate from a distal end of the tubular fiber spinning needle.

In an embodiment, the device may comprise a frame, wherein the at least one nozzle is attached or the frame may comprise one or more spinnerets, wherein each spinneret may comprise one or more nozzles. In such embodiments the second moving means is configured to move the frame holding one or more nozzles or one or more spinnerets in a forward and backward direction, in an upward and downward direction, to rotate or vibrate, or in an up, a down, backward and forward directions.

Further, the second moving means enable to control the deposition of the obtained polymer fibers on the polymer fiber collection surface to achieve a higher and more homogenous density of the deposited polymer fibers and thus to enable to obtain different properties of the polymer fiber material.

The rotational and vibrational movement of the tubular fiber spinning needle may be achieved by moving the unfixed distal end of the at least one nozzle in a circular motion using the first moving means (e.g. a first inlet of the jet of compressed gas in the second end of the at least one nozzle, a mechanical, an electromechanical device). The rotational or the vibrational movement of the tubular fiber spinning needle may be achieved by moving the at least one nozzle in a left, a right, an up or a downward motion using a second moving means. The second moving means may generate a movement of the at least one nozzle that comprises at least one of a rotational, a vibrational, a revolving, a circular movement or a combination of different types of movements.

According to yet another embodiment, the device further comprises a compressed gas heating unit. The compressed gas heating unit comprises a heater configured to heat the compressed gas to a temperature from 50° C., 52° C., 54° C., 56° C., 58° C., 60° C., 62° C., 64° C., 66° C. or 68° C. up to 54° C., 56° C., 58° C., 60° C., 62° C., 64° C., 66° C., 68° C. or 70° C. to achieve better results. The compressed gas is optionally heated to a temperature of 60° C. The jet of compressed gas is optionally heated to compensate for cooling due to decompression and lower the viscosity of the solution in the at least one spinning needle. The heating temperature of the compressed gas may depend on different embodiments according to the present disclosure on which gas is used, a concentration of the polymer solution and the polymers and solvents of the polymer solution, environment temperature of the device when the device is operating.

According to an embodiment, the hollow space is an axially symmetric hollow space. According to the embodiment of the present disclosure the axially symmetric hollow space can be e.g. a cylindrical hollow space, a conical hollow space narrowing towards the opened first end or cylindroconical hollow space having cylindrical hollow space at the second end and conical hollow space at the opened first end. The nozzle having conical hollow space or cylindroconical hollow space is most effective in producing compression effect in the nozzle due to due to the decrease in surface area of the first end of the hollow space, more air is compressed.

Optionally, in the embodiment, the at least one nozzle may further comprise in the second end an abrasion resistant insert to reduce the wear of the nozzle. According to the embodiments of the present disclosure, abrasion resistant insert may be also attached to the hollow space of the nozzle at the opened first end. The nozzle comprising abrasion resistant insert at the opened first end provides even more effective reduction of the wear of the nozzle because due to vibrating, the tubular fiber spinning needle moves against the edge of the cylindrical hollow space at the opened first and thus wears out the edge of the cylindrical hollow space at the opened first end, thus the abrasion resistant insert protects the edges of the hollow space from wear. The abrasion resistant insert can be e.g., a sleeve or other thin-walled cylindrical or conical part to prevent wear between the edges of the hollow space and the tubular fiber spinning needle. Attaching such cylindrical or conical part into the cylindrical hollow space at the opened first end enables to prevent wear out of the tip of the nozzle and thus makes the nozzle more durable. To improve the durability further, the cylindrical or conical part is made of material having low friction properties (e.g., polytetrafluoroethylene (PTFE)) or wear-resistant material (e.g., bronze alloys).

In an example of the cylindroconical hollow space, if a first part of the hollow space is cylindrical and a second part of the hollow space is conical, the cylindrical part in the second end may be ¼-½ in the length of the hollow space. E.g., ¼ part of the length of the hollow space is cylindrical and the second part of the hollow space is conical which is narrowed towards the opened first end of the at least one nozzle.

The effect of the conical hollow space is that it enables to speed up the gas flow near the tip of the tubular fiber spinning needle. The jet of compressed gas is directed into the hollow space perpendicularly to the axis of the nozzle to create revolving gas flow and thereby to apply a torque to the tubular fiber spinning needle. The linear velocity of the revolving gas flow increases as the hollow space narrows and is maximum when exits from the nozzle.

The jet of compressed gas is directed into the hollow space of the nozzle. This enables the tubular fiber spinning needle to revolve which leads to the production of the polymer fibers with a smaller diameter (e.g. 0.2-10 micrometers). In an example, the jet of compressed gas may be directed into the conical hollow space of the nozzle perpendicular to its axis to create a helical movement of the jet of compressed gas. This helical movement of the jet of compressed gas causes the unfixed distal end of the tubular fiber spinning needle to vibrate and revolve for producing fiber from the polymer solution. A linear velocity of the compressed gas flow of the jet of compressed gas that is revolving increases as the conical hollow space narrows and is maximum when the jet of compressed gas exits from the at least one nozzle. This causes the vibrational movement at the unfixed distal end of the tubular fiber spinning needle to produce fiber from the polymer solution.

According to a second aspect, there is provided a method for producing polymer fibers, the method comprising: pumping a polymer solution into at least one nozzle through an inlet of the polymer solution of at least one tubular fiber spinning needle of the at least one nozzle; delivering a jet of compressed gas into the at least one nozzle through a first inlet of compressed gas; applying movement to the at least one tubular fiber spinning needle by the delivered jet of compressed gas; forming a droplet of the polymer solution to a tip of a distal end of the at least one tubular fiber spinning needle; and obtaining a polymer fiber from the formed droplet, wherein a diameter of the polymer fiber is 0.2-10 micrometers, more specifically 0.1-10 micrometers.

When polymer solution is pumped through the inlet of the polymer solution of the tubular fiber spinning needle of the nozzle, the polymer solution exits from the outlet of the polymer solution at the unfixed distal end the and a polymer solution droplet starts forming and the solvent begins to evaporate. The jet of compressed gas, e.g. air, in the hollow space of the nozzle, starts rotating around the tubular fiber spinning needle and the rotational movement of the jet of compressed gas causes the tip of the tubular fiber spinning needle to vibrate and revolve. This extra centrifugal force component acting on the polymer solution affects the resulting fiber morphology and improved fiber production rate. By directing the compressed gas into the hollow space of the nozzle through the first inlet of the jet of compressed gas the compressed gas flow at the tip of the nozzle comprises of a component parallel to the direction of the polymer solution flow and a component that is tangential to the surface of the polymer solution jet and perpendicular to the direction of the flow of jet of the polymer solution.

The jet of polymer solution gradually turns at first into a polymer solution droplet by the rotating motion of the tubular fiber spinning needle, which breaks the polymer solution jet into droplets. The droplets are then accelerated and elongated in the jet of compressed gas, resulting in a fiber forming from the polymer solution droplet. The forming polymer fiber is then stretched out by the jet of compressed gas directed through the hollow space of the nozzle.

The polymer fiber starts forming and grows from the polymer solution droplet due to the force of the jet of compressed gas and vibrational spiral movement of the tubular fiber spinning needle which further causes the circular movement of the polymer solution droplet. The forming polymer fiber vibrates together with the polymer solution droplet until its force separates itself from the polymer solution droplet, the polymer fiber finally separates from the distal end of the tubular fiber spinning needle and the obtained polymer fiber flies through air towards the surface, e.g. fiber collection surface. On the fiber collection surface, the formed polymer fibers attached to each other and form the polymer fiber material. The rotational movement of the air jet also causes the tip of the needle to vibrate and revolve. This extra centrifugal force component acting on the polymer solution affects the resulting fiber morphology and improved fiber production rate.

The method thus enables the production of polymer fibers from the polymer solution prepared from a wide range of bio-based polymers and synthetic polymers. The method according to the present embodiment increases the production rate of the polymer fibers due to a centrifugal force acting upon the at least one tubular fiber spinning needle. The rotational or vibrational movement of the unfixed distal end of the at least one tubular fiber spinning needle creates the centrifugal force which acts on the polymer solution and breaks the polymer solution into polymer solution droplets. The polymer solution droplets are then accelerated and elongated in the airflow, resulting in a fiber forming from each droplet. In the embodiments according to the present disclosure comprising two or more nozzles, several fibers are formed at the same time, giving rise to a higher fiber production rate. The polymer fiber production rate further depends on optimized operational parameters. The optimized operational parameters may include a rate and pressure of pumping the polymer solution into the one or more nozzles; diameter of the tubular fiber spinning needle; the total number of the nozzles incorporated into the device; viscosity of the polymer solution; a temperature of the compressed gas and the polymer solution; a diameter of the hollow space of the nozzle.

In an embodiment, the polymer solution is pumped into the tubular fiber spinning needle with e.g. pressure of 0.8 bar, wherein the nozzle having a diameter of 3 mm and the tubular fiber spinning needle having a diameter of 0.8 mm, the jet of compressed gas is delivered at a pressure of 0.3 bar into the first inlet of compressed gas of the nozzle. The tubular fiber spinning needle revolving inside the nozzle leads to the forming of the polymer fibers with a diameter ranging from 0.2 to 10 micrometers.

The diameter of the obtained polymer fiber can be from 0.2 micrometers (μm) to 10 μm, more specifically 0.1-10 micrometers. The diameter of the polymer fiber can thus be from 0.1, 0.2, 0.3, 0.4, 0.5, 0.6, 0.7, 0.8, 0.9, 1, 1.5, 2, 2.5, 3, 3.5, 4, 4.5, 5, 5.5, 6, 6.5, 7, 7.5, 8, 8.5 or 9 up to 0.2, 0.3, 0.4, 0.5, 0.6, 0.7, 0.8, 0.9, 1, 1.5, 2, 2.5, 3, 3.5, 4, 4.5, 5, 5.5, 6, 6.5, 7, 7.5, 8, 8.5, 9 or 10 micrometers. The preferred diameter of the polymer fiber is from 0.1 micrometers to 5 micrometers. E.g., in an embodiment, wherein the concentration of the at least one polymer is 15%, the diameter of the obtained polymer fiber is 100 nanometers (nm).

According to an embodiment, the method is performed under conditions, wherein an injection rate of pumping of the polymer solution to the at least one tubular fiber spinning needle is 1 microliter/min-3.5 ml/min per nozzle; a spinning rate of the polymer fibers per nozzle is 0.2-25 grams per minute; a pressure of the compressed gas is delivered at 0.2 bar-2 bar; a pressure of pumping the polymer solution into the at least one tubular fiber spinning needle is 0.5-2 bar; and a temperature of the compressed gas is 20-120° C., wherein the compressed gas is selected from a group comprising air, nitrogen, argon, oxygen, carbon dioxide and mixtures thereof. The injection rate of pumping of the polymer solution to the tubular fiber spinning needle may be from 0.001, 0.01, 0.1, 0.5, 1, 1.5, 2, 2.5, or 3 milliliter/min per nozzle up to 0.005, 0.05, 0.1, 0.25, 0.5, 0.75, 1, 1.25, 1.5, 1.75, 2, 2.25, 2.5, 2.75, 3, 3.25 or 3.5 milliliter/min per nozzle. The injection rate in the said ranges helps to improve the fiber production rate and enables continuous in-line production of polymer. The spinning speed of the polymer fibers per nozzle may be from 0.2, 0.5, 1, 2.5, 5, 7.5, 10, 12.5, 15, 17.5, 20 or 22.5 grams per minute up to 0.5, 1, 2.5, 5, 7.5, 10, 12.5, 15, 17.5, 20, 22.5 or 25 grams per minute, which improves the morphology polymer fiber that is produced and the fiber production rate of the device. The pressure of the compressed gas may be from 0.2, 0.4, 0.6, 0.8, 1, 1.2, 1.4, 1.6, 1.8 or 2 bar up to 0.3, 0.5, 0.7, 0.9, 1.1, 1.3, 1.5, 1.7, 1.9 or 2.1 bar. The polymer solution may be pumped into the tubular fiber spinning needle with pressure ranging from 0.5-2 bar. The pressure at which the pump pumps the polymer solution into the tubular fiber spinning needle can be from 0.1, 0.2, 0.3, 0.4, 0.5, 0.6, 0.7, 0.8, 0.9, 1, 1.1, 1.2, 1.3, 1.4, 1.5, 1.6, 1.7, 1.8 or 1.9 bar up to 0.2, 0.3, 0.4, 0.5, 0.6, 0.7, 0.8, 0.9, 1, 1.1, 1.2, 1.3, 1.4, 1.5, 1.6, 1.7, 1.8 1.9 or 2 bar, which enables the continuous line production of the polymer fibers, thereby increasing the fiber production rate. The polymer solution may be pumped into the tubular fiber spinning needle through the inlet of the polymer solution under pressure of e.g. 0.8 bar, which enables the continuous line production of the polymer fibers. The temperature of the compressed gas can be from 20° C., 25° C., 30° C., 35° C., 40° C., 45° C., 50° C., 55° C., 60° C., 65° C., 70° C., 75° C., 80° C., 95° C., 90° C., 95° C., 100° C., 105° C., 110° C. or 115° C. up to 25° C., 30° C., 35° C., 40° C., 45° C., 50° C., 55° C., 60° C., 65° C., 70° C., 75° C., 80° C., 95° C., 90° C., 95° C., 100° C., 105° C., 110° C., 115° C. or 120° C. Preferably the compressed gas is heated to a temperature of 60° C., which enables to achieve the best results. To increase the evaporation, the temperature of compressed gas may be more than 60° C., i.e. from 60° C. up to 120° C. The jet of compressed gas may be heated to lessen the cooling effect from decompression.

According to a third aspect, there is provided a polymer solution for producing polymer fibers comprising at least one polymer dissolved in at least one solvent, wherein a concentration of the at least one polymer is 9%-45% by weight of the at least one solvent, and a viscosity of the polymer solution is 1 millipascal-second-5000 pascal-second. Such polymer solution helps to achieve a higher fiber production rate of producing micro- or nanofibers than conventional methods, which is achieved by applying a centrifugal force, which acting upon the spinning needle and enabling the injection rates more than ten times higher than known methods having polymer solution injection rates up to 3.5 ml/min per nozzle. The polymer of the polymer solution, according to the embodiment, does not precipitate out of solution at the tip of the needle and has a viscosity suitable for polymer fiber spinning according to the present method. Optionally, the polymer solution may be heated to dissolve the one or more polymers in the solvent to achieve a well dispersed solution. The concentration of the at least one polymer can be from 9, 12, 15, 18, 21, 24, 27, 30, 33, 36, 39 or 42% by weight of the at least one solvent up to 12, 15, 18, 21, 24, 27, 30, 33, 36, 39, 42 or 45% by weight of the at least one solvent. The viscosity of the polymer solution can be from 0.001, 0.01, 0.1, 1, 10, 100, 1000, 2000, 3000, 4000, 5000, 6000 or 7000 pascal-second up to 0.01, 0.1, 1, 10, 100, 1000, 2000, 3000, 4000, 5000, 6000, 7000 or 8000 pascal-second. Such a polymer solution enables to form polymer fibers having a unique twisted ribbon type mesh morphology.

According to an embodiment, the at least one polymer is selected from a group of bio-based polymers comprising gelatin, collagen, chitosan, chitin, proteins (e.g., soy protein, pea protein), silk protein, polylactic acid, polycaprolactones, alginate and algae based polysaccharides, zein, gluten, poly (l-lactic acid), polyethylene oxide, cellulose acetate, poly (lactic-co-glycolic acid), mixtures thereof and compounds derived therefrom or the at least one polymer is optionally selected from a group of synthetic polymers comprising polymethylmethacrylate, polyvinyl alcohol, polystyrene, polyaniline, polyamides, polyacrylonitrile, polyurethanes, styrene-acetonitrile copolymer, natural and synthetic rubbers, mixtures thereof and compounds derived therefrom. The bio-based polymers are significantly a more sustainable material for producing nanofibers when compared to the synthetic polymers. The polymer fiber materials that are made from bio-based polymers are biodegradable and biosorbable. The usage of the bio-based polymers reduces the usage of non-biodegradable plastic waste. The main advantage in the production of biopolymer fibers is that the device uses water as a solvent. Thus, the device uses no toxic chemicals for manufacturing the biopolymer fibers (e.g. gelatin fibers). The polymer fibers made from the bio-based polymers are used in the medical field where it can be advantageous for used materials to decompose in the body after completing its task. The biocompatibility and absorbability of alginate and algae based polysaccharides, zein, gluten, poly (l-lactic acid), polyethylene oxide, cellulose acetate, poly(lactic-co-glycolic acid) enable to use these polymers in production of tissue engineering materials.

The use of synthetic polymers according to the embodiments of the present disclosure enables to obtain porous polymer fibers. Porous polymer fibers enable to produce materials having high specific surface materials, which are required e.g. for energy storage. Using the synthetic polymers according to the embodiments of the present disclosure also enables to obtain polymer fibres with a smaller diameter, thus providing better properties (e.g. higher stiffness) of the materials made of such polymer fibers. This allows such polymer fiber materials to be used in different applications.

According to an embodiment, the at least one solvent is selected from a group comprising water, alcohols, ethyl acetate, tetrahydrofuran, acetone, acetic acid, formic acid, toluene, chloroform, dimethylformamide and mixtures thereof. These solvents enable non-electrostatic fiber spinning method according to the present disclosure and therefore do not require high-voltage, which is more safer. As the present method enables to use both aforementioned synthetic polymers and bio-based polymers for producing polymer fibers then it is required that the used polymers can be dissolved in the solvent. Since bio-based polymers generally do not melt, their only formulation is to dissolve them in a solvent. These solvents enable effectively to dissolve both synthetic polymers and bio-based polymers for preparing the polymer solution to be used in the polymer fiber spinning process according to the present disclosure. As the polymers can be dissolved in the said solvents there is no specific need to use additional energy for melting the polymers, which enables to produce polymer fibers more energy efficiently.

In the embodiments of the present disclosure, wherein the solvent may damage the parts of the nozzle or spinneret, the nozzle and the spinneret may be formed of solvent resistant material, e.g., metal or 3D printed plastic.

Additionally, these solvents can be evaporated when the polymer solution exits from the outlet of the polymer solution at the distal end of the tubular fiber spinning needle by the jet of compressed air when the jet of polymer solution starts gradually turning into a polymer solution droplet and then to polymer fiber. More specifically, the jet of compressed air stretches the polymer fiber from the polymer solution droplet out and elongates it in the compressed gas flow during its spinning process and helps the solvent to start evaporating.

In one example, 13% weight for weight (w/w) of the polymer solution is produced by dissolving styrene-acetonitrile copolymer (SAN) in ethyl acetate. The polymer solution is then stirred until it is completely dissolved. The polymer solution is pumped into the tubular fiber spinning needle of at least one nozzle with a speed of 2.7 ml/minute per nozzle. The compressed gas, e.g. air, is delivered at 0.3 bar into the hollow space of the nozzle. The polymer fibers spinning process is performed and the obtained polymer fibers are collected on the air permeable fiber collection surface of the collection unit placed about 70 cm from the unfixed distal end of the tubular fiber spinning needle of the at least one nozzle.

In another example, 33% w/w of the polymer solution is produced by dissolving gelatin in water. The polymer solution is stirred until it is completely dissolved. The polymer solution is pumped into the tubular fiber spinning needle of at least one nozzle with a speed of 2.7 ml/minute per nozzle. The compressed gas is delivered at 0.3 bar into the hollow space of the nozzle. The polymer fibers spinning process is performed and the obtained polymer fibers are collected on the air permeable fiber collection surface of the collection unit placed about 70 cm from the unfixed distal end of the tubular fiber spinning needle of the at least one nozzle. An advantage in the production of bio-based polymer, e.g. gelatin fibers is that water can be used as a solvent. Thus, no toxic chemicals are used in the manufacture of polymer fibers.

In an example for producing a material comprising polymer fibers, a 33% w/w of a solids solution is made in water. The solids comprise 14% sugar and 86% gelatin. The solids are mixed in the water and heated to obtain a homogenous polymer solution. The polymer solution is pumped into one or more spinnerets, wherein each spinneret comprises one or more nozzles, under a pressure of 0.8 bar. The compressed gas, e.g. air, is then directed into the one or more nozzles such that the pressure inside the hollow space of the one or more nozzles is around 0.3 bar. The temperature of the compressed air may be 50-70 ° C., the best results can be achieved when the temperature of the compressed air is 60° C. The polymer fiber spinning speed is around 0.2 grams/minute per nozzle. The moving speed of the air permeable fiber collection surface of the collector unit for collecting the polymer fibers is configured to be 5 meters per hour. The polymer fibers spinning process is performed and the obtained polymer fibers are collected on the moving air permeable fiber collection surface of the collection unit, wherein the collected polymer fibers by falling on top of each other form the polymer fiber material. The obtained polymer fiber material has a surface density of 76 g/m$^2$.

An advantage of using easily volatile solvents, e.g. ethyl acetate, with synthetic polymers, e.g. styrene-acetonitrile copolymer, for producing polymer fibers is that easily volatile solvents because of low boiling point evaporate quickly after polymer fiber formulation, thus lead to non-toxic polymer fibers.

According to an embodiment, a material comprising polymer fibers produced by the present method is used for making a non-woven filter material, a leather-like textile, a biomaterial for bone regrowth, a wound care material, a 3D scaffold for cell cultivation and tissue engineering, an electrode material for capacitors, ceramic nanofibers (e.g., Al2O3 nanofibers), cell-cultured meat. The material comprising polymer fibers is airy and fluffy having nanofibrous twisted ribbon type mesh morphology, which results in the superior material's tensile strength and better mechanical properties than previously conventional spinning technologies enable. A thickness of the polymer material formed from the polymer fibers may be from 10 grams per square meter ($g/m^2$) to 400 $g/m^2$. The thickness of the polymer material can thus be from 10, 50, 100, 150, 200, 250, 300 or 350 up to 50, 100, 150, 200, 250, 300, 350 or 400 $g/m^2$.

In an embodiment, the obtained polymer fiber has a tensile strength ranging from 1 gigapascal (GPa) to 3 GPa and a stiffness ranging from 50 GPa to 170 GPa. The polymer fiber optionally has a tensile strength of 1.3 GPa and stiffness of 95 GPa. The polymer fiber optionally has a tensile strength of 2.3 GPa and stiffness of 160 GPa. The tensile strength of the polymer material can be from 0.5, 1, 1.5, 2 or 2.5 GPa up to 1, 1.5, 2, 2.5 or 3 GPa. The stiffness of the polymer material can thus be from 2.3, 5, 10, 20, 40, 60, 80, 100, 120 or 140 GPa up to 10, 20, 40, 60, 80, 100, 120, 140 or 160 GPa. This tensile strength and the stiffness of the polymer fiber provide an improved morphology for the polymer fiber which performs better than other dense polymer materials. The polymer fiber material may have a surface density ranging from 60 $g/m^2$ to 120 $g/m^2$. The polymer fiber material optionally has a surface density of about 76 $g/m^2$.

The polymer fiber material is optionally used for making air filtration devices such as high-efficiency particulate air (HEPA) filters, industrial dust collectors, face masks and respirators. The polymer fiber material is optionally used for making liquid filtration devices used for drinking water purification, wastewater treatment and fuel and oil filtration. The polymer fiber material may be used in battery separators, battery electrodes and fuel cells as catalyst support, in wound care and for making 3D scaffolds for musculoskeletal tissue engineering (e.g. bone, cartilage, ligament, and skeletal muscle), skin tissue engineering, vascular tissue engineering, neural tissue engineering, and as carriers for the controlled delivery of drugs, proteins, and DNA. The polymer fiber material is optionally used in the field of applied acoustics for the noise control, in various industrial equipment such as beverage, water purification equipment for trapping hydrocarbon pollutants, for making a wide range of sports apparel. Sports clothing produced with the polymer fiber material may include an optimal balance of comfort, air permeability, wind and water resistance for extreme cold weather sports.

The polymer fiber material is optionally used for making anti-slip footwear soles, sports clothing with increased wicking for producing protection against cold and rain, breathable clothing regulating body temperature in extreme climates, and for making edible scaffolds for producing lab-grown cultured meat products. The polymer fiber material may be used for making gelatin based leather-like textile that is cheaper than the leather and which can be used in face masks and respirators that could enhance filter performance for capturing of naturally occurring nanoparticles such as viruses, as well as micron-sized particles such as bacteria or man-made particles such as soot from diesel exhaust. The polymer fiber material is optionally used for producing bio-material for dental tissue regeneration in dentistry and may be used in supercapacitor electrode materials for improving electrochemical performance.

DETAILED DESCRIPTION OF THE DRAWINGS

FIG. 1 is a schematic illustration of a device 124 for producing polymer fibers according to an embodiment of the present disclosure. The device 124 includes at least one nozzle 100 including a body 102 having a hollow space 128, an opened first end 104, a second end 106 opposite to the opened first end 104, a first inlet of a jet of compressed gas 108 in the second end 106, and tubular fiber spinning needle 110. The tubular fiber spinning needle 110 comprises an unfixed distal end 112, a proximal end 114 opposite to the unfixed distal end 112, an inlet of a polymer solution 116 at the proximal end 114, and an outlet of the polymer solution 118 at the unfixed distal end 112. The device 124 comprises a pump 120 configured to pump the polymer solution into the tubular fiber spinning needle 110 through the inlet of a polymer solution 116, and a gas compressor 122 configured to direct a jet of compressed gas into the hollow space 128 through the first inlet of a jet of compressed gas 108. The at least one nozzle 100 is configured to receive the jet of compressed gas through the first inlet of a jet of compressed gas 108. The tubular fiber spinning needle 110 is being mounted through the second end 106 and through the hollow space of the at least one nozzle 100. The tubular fiber spinning needle 110 protrudes from the opened first end 104. The proximal end 114 of the tubular fiber spinning needle 110 is fixed to the second end 106 of the at least one nozzle 100. The jet of compressed gas may move in a spiral or helical trajectory and cause the unfixed distal end 112 of the tubular fiber spinning needle 110 to revolve and exit the polymer solution droplets through the outlet of the polymer solution 118. The polymer fibers are formed from the polymer solution droplets when the polymer solution droplets are accelerated and elongated in the gas flow provided by the jet of compressed gas.

Figure 2A:
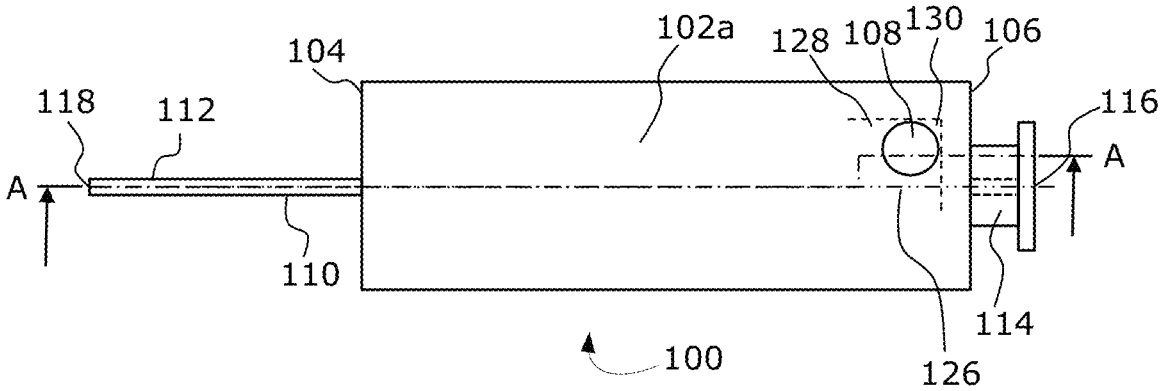
FIG. 2A is a schematic illustration of a top-down view of at the nozzle of FIG. 1 having a cylindrical body configured to produce polymer fibers in accordance with an embodiment of the present disclosure.
Figure 2B:
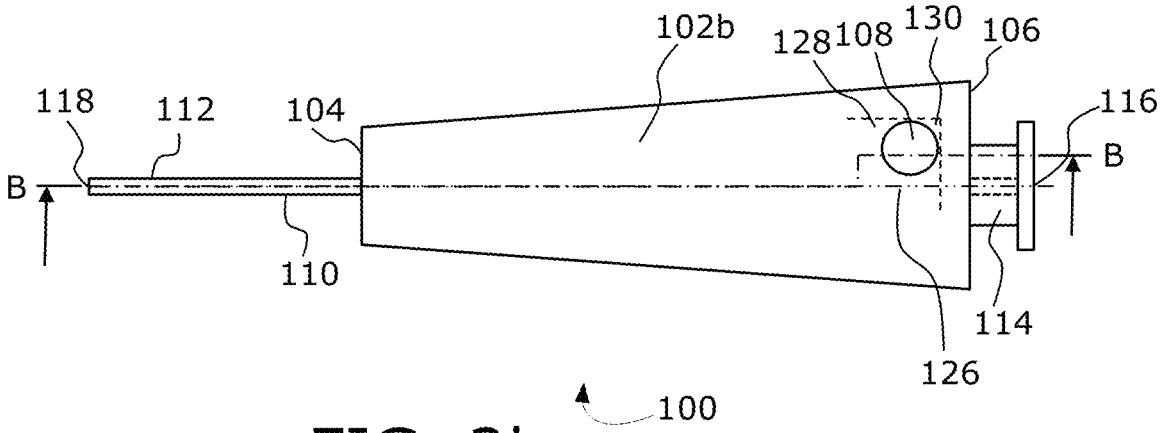
FIG. 2B is a schematic illustration of a top-down view of at the nozzle of FIG. 1 having a conical body configured to produce polymer fibers in accordance with an embodiment of the present disclosure.

FIG. 2A and FIG. 2B are schematic illustrations of a top-down view of the nozzle 100 of FIG. 1. Figure FIG. 2A illustrates an embodiment, wherein the nozzle 100 comprises a cylindrical body 102*a* configured to produce polymer fibers according to the embodiment of the present disclosure. FIG. 2B illustrates an embodiment, wherein the nozzle 100 comprises a conical body 102*b* configured to produce polymer fibers according to the embodiment of the present disclosure. In the embodiments shown in figures FIG. 2A and FIG. 2B the at nozzle 100 includes a body 102*a*, 102*b* having a hollow space, the opened first end 104, the second end 106 opposite to the opened first end 104, the first inlet of the jet of compressed gas 108 in the second end 106, and the tubular fiber spinning needle 110. The tubular fiber spinning needle 110 includes the unfixed distal end 112, the proximal end 114 opposite to the unfixed distal end 112, the inlet of the polymer solution 116, and the outlet of the polymer solution 118. The nozzle 100 is configured to receive the jet of compressed gas through the first inlet of a jet of compressed gas 108. The first inlet of the compressed gas 108 is formed away from the nozzle axis 126 and formed through the nozzle body 102*a*, 102*b* of the nozzle so that the distal edge 130 of the hollow space 128 of the nozzle and the edge of the first inlet of the compressed gas 108 are tangential, i.e. aligned. This is necessary to create a rotating vortex of the compressed gas. The tubular fiber spinning needle 110 is being mounted through the second end 106 and the hollow space of the nozzle 100. The tubular fiber spinning needle 110 protrudes from the opened first end 104. The inlet of the polymer solution 116 is provided at the proximal end 114 for receiving the polymer solution. The proximal end 114 of the tubular fiber spinning needle 110 is fixed to the second end 106 of the nozzle 100. The outlet of the polymer solution 118 is provided at the unfixed distal end 112 for exiting the polymer solution from the unfixed distal end 112 of the least one tubular fiber spinning needle 110. The jet of compressed gas may move in a spiral or helical trajectory and cause the unfixed distal end 112 of the tubular fiber spinning needle 110 to revolve vibrationally.

Figure 3A:
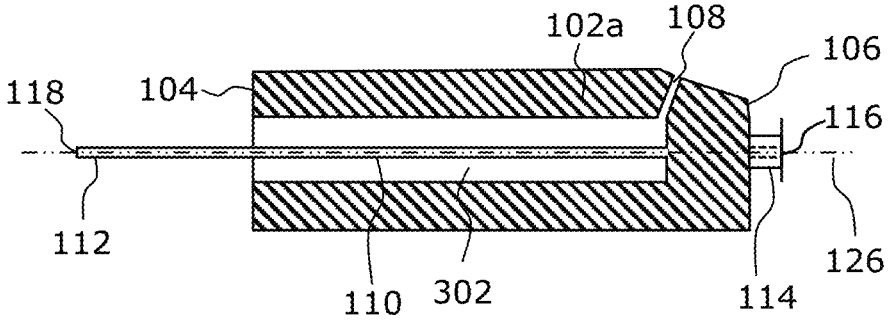
FIG. 3A is a schematic illustration of a cross-sectional view A-A of the nozzle of FIG. 2*a* having a cylindrical hollow space in accordance with an embodiment of the present disclosure.

FIG. 3A is a schematic illustration of a cross-sectional view A-A of the nozzle 100 of FIG. 1 having a cylindrical hollow space 302 according to an embodiment of the present disclosure. The nozzle 100 includes the cylindrical body 102*a* having the cylindrical hollow space 302, the opened first end 104, the second end 106 opposite to the opened first end 104, the first inlet of the jet of compressed gas 108 in the second end 106, and the tubular fiber spinning needle 110. The tubular fiber spinning needle 110 includes the unfixed distal end 112, the proximal end 114 opposite to the unfixed distal end 112, the inlet of the polymer solution 116, and the outlet of the polymer solution 118. The nozzle 100 is configured to receive the jet of compressed gas through the first inlet of a jet of compressed gas 108. The tubular fiber spinning needle 110 is being mounted through the second end 106 and the cylindrical hollow space 302 of the nozzle 100. The tubular fiber spinning needle 110 protrudes from the opened first end 104. The inlet of the polymer solution 116 is provided at the proximal end 114, and the outlet of the polymer solution 118 is provided at the unfixed distal end 112. The proximal end 114 of the tubular fiber spinning needle 110 is fixed to the second end 106 of the nozzle 100. The jet of compressed gas is directed into the cylindrical hollow space 302 perpendicularly to the axis 126 of the nozzle 100 to create a spiral movement of the jet of compressed gas. The spiral movement of the jet of compressed gas causes the unfixed distal end 112 of the tubular fiber spinning needle 110 to vibrate and revolve for producing fiber from the polymer solution.

Figure 3B:
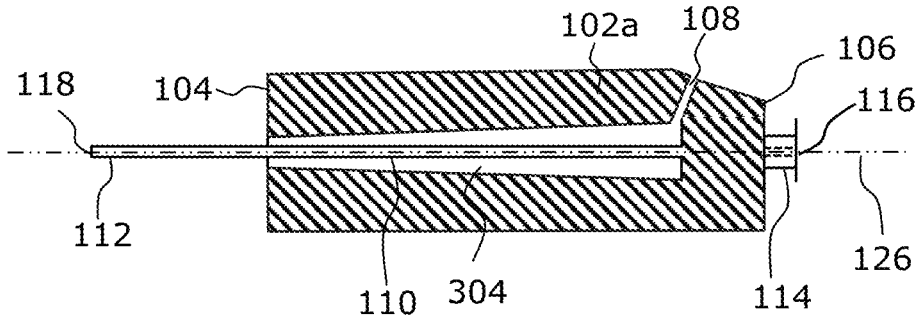
FIG. 3B is a schematic illustration of a cross-sectional view A-A of the nozzle of FIG. 2*a* having a conical hollow space in accordance with an embodiment of the present disclosure.

FIG. 3B is a schematic illustration of a cross-sectional view A-A of the at least one nozzle 100 of FIG. 1 having a conical hollow space 304 according to an embodiment of the present disclosure. The nozzle 100 includes the cylindrical body 102*a* having the conical hollow space 304, the opened first end 104, the second end 106 opposite to the opened first end 104, the first inlet of a jet of compressed gas 108 in the second end 106, and the tubular fiber spinning needle 110. The tubular fiber spinning needle 110 includes the unfixed distal end 112, the proximal end 114 opposite to the unfixed distal end 112, the inlet of the polymer solution 116, and the outlet of the polymer solution 118. The nozzle 100 is configured to receive the jet of compressed gas through the first inlet of a jet of compressed gas 108. The tubular fiber spinning needle 110 is being mounted through the second end 106 and the conical hollow space 304 of the nozzle 100. The tubular fiber spinning needle 110 protrudes from the opened first end 104. The inlet of the polymer solution 116 is provided at the proximal end 114, and the outlet of the polymer solution 118 is provided at the unfixed distal end 112. The proximal end 114 of the tubular fiber spinning needle 110 is fixed to the second end 106 of the nozzle 100. The jet of compressed gas is directed into the conical hollow space 304 perpendicularly to the axis 126 of the nozzle 100 to create a spiral movement of the jet of compressed gas. The spiral movement of the jet of compressed gas causes the unfixed distal end 112 of the tubular fiber spinning needle 110 to vibrate and revolve for producing fiber from the polymer solution.

Figure 3C:
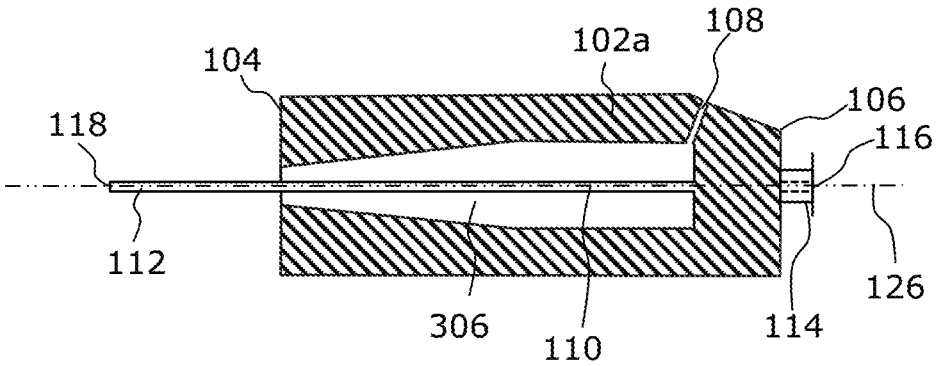
FIG. 3C is a schematic illustration of a cross-sectional view A-A of nozzle of FIG. 2*a* having a cylindroconical hollow space in accordance with an embodiment of the present disclosure.

FIG. 3C is a schematic illustration of a cross-sectional view A-A of the at least one nozzle 100 of FIG. 1 having a cylindroconical hollow space 306 according to an embodiment of the present disclosure. The nozzle 100 includes the cylindrical body 102*a* having the cylindroconical hollow space 306, the opened first end 104, the second end 106 opposite to the opened first end 104, the first inlet of the jet of compressed gas 108 in the second end 106, and the tubular fiber spinning needle 110. The tubular fiber spinning needle 110 includes the unfixed distal end 112, the proximal end 114 opposite to the unfixed distal end 112, the inlet of a polymer solution 116, and the outlet of the polymer solution 118. The nozzle 100 is configured to receive the jet of compressed gas through the first inlet of a jet of compressed gas 108. The tubular fiber spinning needle 110 is being mounted through the second end 106 and the cylindroconical hollow space 306 of the nozzle 100. The tubular fiber spinning needle 110 protrudes from the opened first end 104. The inlet of the polymer solution 116 is provided at the proximal end 114, and the outlet of the polymer solution 118 is provided at the unfixed distal end 112. The proximal end 114 of the tubular fiber spinning needle 110 is fixed to the second end 106 of the nozzle 100. The jet of compressed gas is directed into the axially symmetric hollow space 306 perpendicularly to the axis 126 to create a spiral movement of the jet of compressed gas. The spiral movement of the jet of compressed gas causes the unfixed distal end 112 of the tubular fiber spinning needle 110 to vibrate and revolve for producing fiber from the polymer solution.

FIG. 3D is a schematic illustration of a cross-sectional view B-B of the nozzle of FIG. 2*b* according to an embodiment of the present disclosure, wherein the nozzle 310 includes the conical body 312 having a conical hollow space 314, an opened first end 316, a second end 318 opposite to the opened first end 316, a first inlet of the jet of compressed gas 320 in the second end 318, tubular fiber spinning needle 322. The tubular fiber spinning needle 322 includes an unfixed distal end 324, a proximal end 326 opposite to the unfixed distal end 324, an inlet of a polymer solution 328, and an outlet of the polymer solution 330. The nozzle 310 is configured to receive the jet of compressed gas through the first inlet of a jet of compressed gas 320. The tubular fiber spinning needle 322 is being mounted through the second end 318 and the conical hollow space 314 of the nozzle 310. The tubular fiber spinning needle 322 protrudes from the opened first end 316. The inlet of the polymer solution 328 is provided at the proximal end 326, and the outlet of the polymer solution 330 is provided at the unfixed distal end 324. The proximal end 326 of the tubular fiber spinning needle 322 is fixed to the second end 318 of the nozzle 310. The jet of compressed gas is directed into the conical hollow space 314 of the conical body 312 perpendicularly to the axis 126 to create a spiral movement of the jet of compressed gas. The spiral movement of the jet of compressed gas causes the unfixed distal end 324 of the tubular fiber spinning needle 322 to vibrate and revolve for producing fiber from the polymer solution.

Figure 3E:
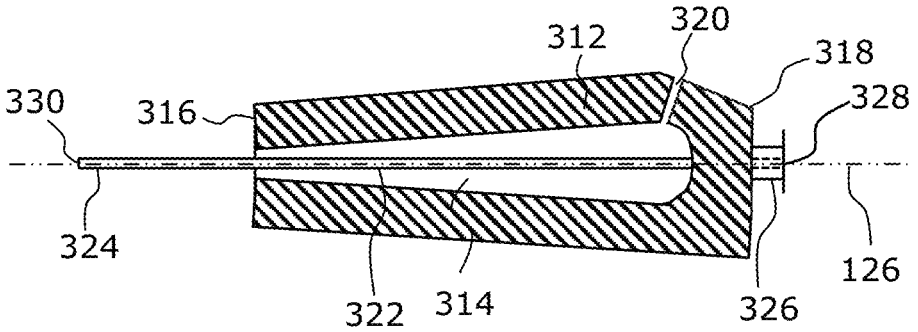
FIG. 3E is a schematic illustration of the the nozzle comprizing a sleeve in accordance with the embodiments of the present disclosure.
Figure 3E:
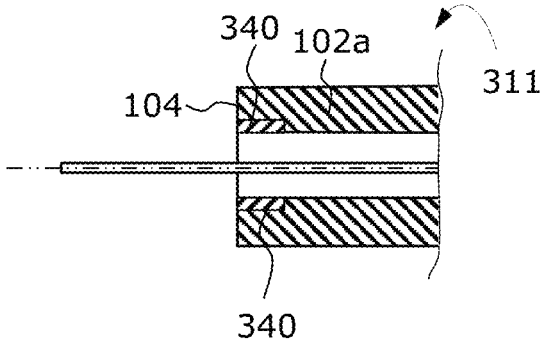

FIG. 3E is a schematic illustration of the the nozzle 311 comprizing a sleeve 340 in accordance with the embodiments of the present disclosure. According to the embodiments, the nozzle 311 comprises the sleeve 340 at the opened first end 104, wherein the sleeve 340 is attached into the cylindrical body 102*a* at the opened first end 104.

Figure 4A:
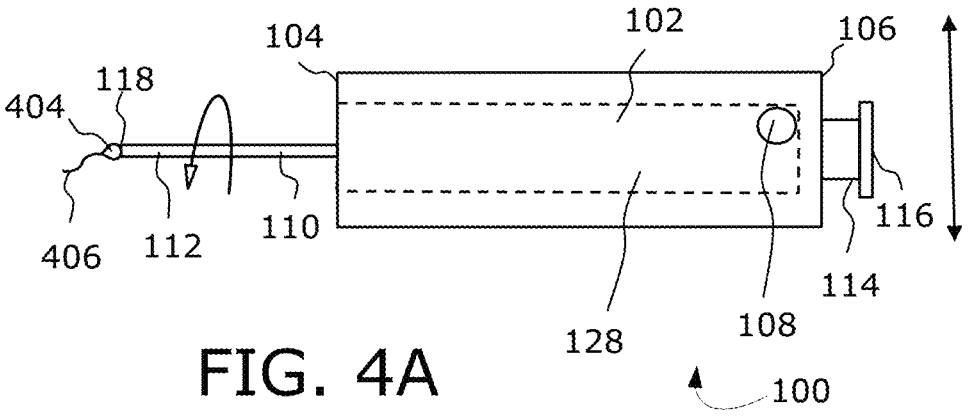
FIG. 4A is a schematic illustration of the vibrational movement of a tubular fiber spinning needle of the nozzle and polymer fiber spinning process in accordance with an embodiment of the present disclosure.

FIG. 4A is a schematic illustration of the nozzle 100 of FIG. 1 illustrating the vibrational movement of the tubular fiber spinning needle 110 and the polymer fiber 406 spinning process in accordance with an embodiment of the present disclosure. The nozzle 100 includes the body 102, the opened first end 104, the second end 106 opposite to the opened first end 104, the first inlet of compressed gas 108 in the second end 106, and the tubular fiber spinning needle 110. The tubular fiber spinning needle 110 includes the unfixed distal end 112, the proximal end 114 opposite to the unfixed distal end 112, the inlet of a polymer solution 116, and the outlet of the polymer solution 118. The nozzle 100 is configured to receive a jet of compressed gas through the first inlet of the jet of compressed gas 108. The tubular fiber spinning needle 110 receives the polymer solution through the inlet of the polymer solution 116. The jet of compressed gas moves in a forward direction and in a circular motion inside the hollow space 128 of the nozzle 100. The combination of the forward and circular movement of the jet of compressed gas produces a spiral or helical movement of the unfixed distal end 112 of the tubular fiber spinning needle 110 which causes the unfixed distal end 112 to revolve (e.g. vibrationally rotate). The polymer solution exits through the outlet of the polymer solution 118 and the vibrational rotating of the distal end of the tubular fiber spinning needle creates a centrifugal force which is acting on the polymer solution and breaks the polymer solution into a polymer solution droplet 404. The polymer fiber 406 starts growing from the polymer solution droplet 404 when the polymer solution droplet is accelerated and elongated in the gas flow provided by the jet of compressed gas. The polymer fiber 406 grows from the polymer solution droplet 404 by the rotational movement at the unfixed distal end 112 of the tubular fiber spinning needle 110. The nozzle 100 may be configured to move in at least one left and right, up and down directions to provide additional movement to the nozzle 100.

Figure 4B:
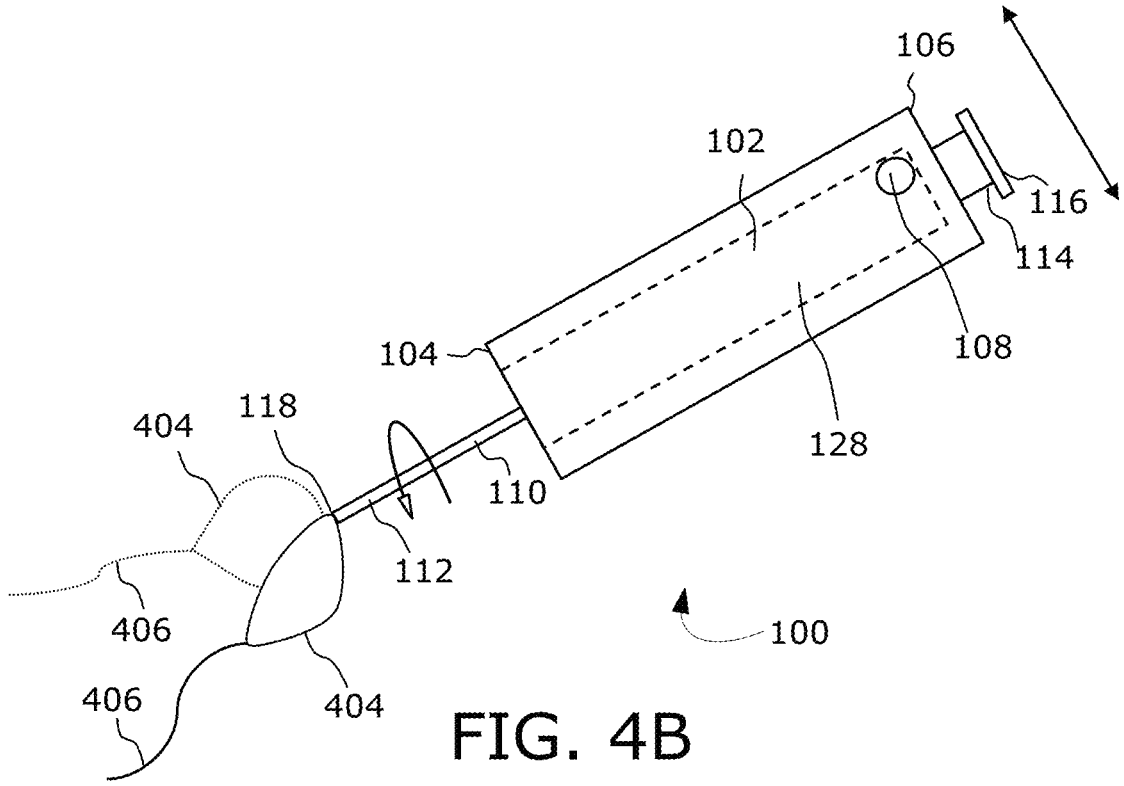
FIG. 4B is a schematic illustration of the vibrational movement of a tubular fiber spinning needle of the nozzle and a polymer fiber spinning process from a circularly moving polymer solution droplet of FIG. 4*a* in accordance with the embodiment of the present disclosure.

FIG. 4B is a schematic illustration of the vibrational movement of a tubular fiber spinning needle of the nozzle 100 and the polymer fiber growing process from a circularly moving polymer solution droplet of FIG. 4A according to the embodiment of the present disclosure. The jet of compressed gas and the vibrational movement at the unfixed distal end 112 of the tubular fiber spinning needle 110 further causes a circular vibration of the polymer solution droplet 404. During the vibrational movement of the distal end 112 of the tubular fiber spinning needle 110, the polymer solution droplet 404 and the growing polymer fiber 406 vibrate circularly together with the distal end 112. The polymer fiber 406 continues growing from the polymer solution droplet 404 till the jet of compressed gas separates the polymer fiber 406 from the polymer solution droplet 404. The growth of the polymer fiber 406 is initiated by the vibrational movement at the unfixed distal end 112 of the tubular fiber spinning needle 110. The formed polymer fiber 406 separated from the polymer solution droplet flies then in the gas flow through the air away from the nozzle 100. The centrifugal force acting on the polymer solution affects improving the morphology of the polymer fiber 406 and the production rate of the polymer fibers 406.

Figure 5:
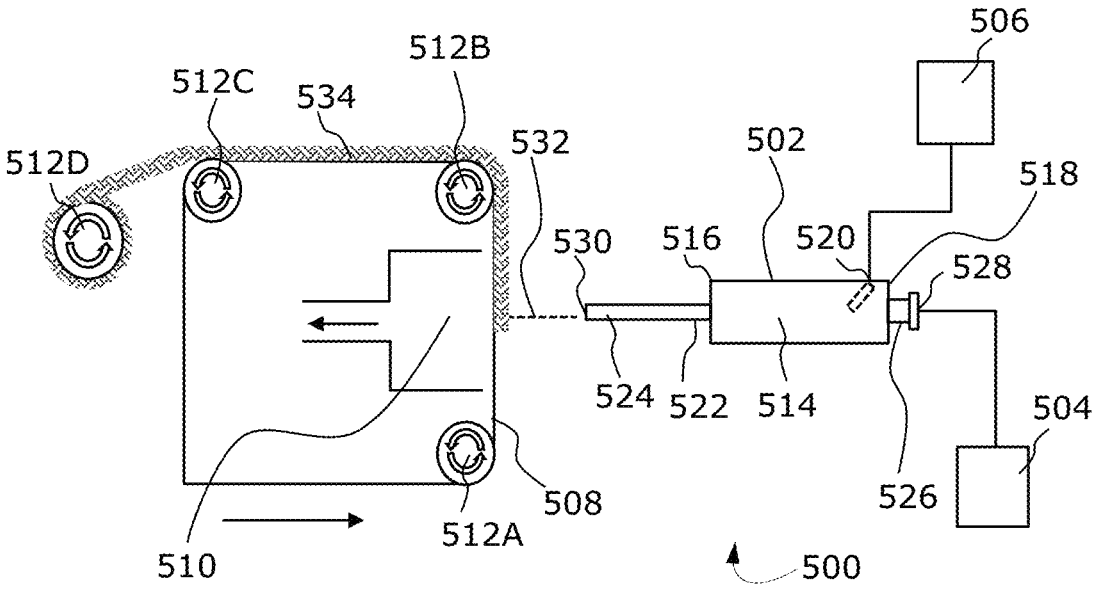
FIG. 5 is a schematic illustration of a device for producing a polymer fiber material according to an embodiment of the present disclosure.

FIG. 5 is a schematic illustration of a device 500 for producing a polymer fiber material 534 according to an embodiment of the present disclosure. The device 500 includes at least one nozzle 502, a pump 504 to pump a polymer solution, a gas compressor 506 to direct a jet of compressed gas, an air permeable fiber collection surface 508, a suction unit 510, and a first roller 512A, a second roller 512B, a third roller 512C and a wind-up roller 512D. The at least one nozzle 502 includes a body 514, an opened first end 516, a second end 518 opposite to the opened first end 516, a first inlet of a jet of compressed gas 520 in the second end 518, and tubular fiber spinning needle 522. The tubular fiber spinning needle 522 includes an unfixed distal end 524, a proximal end 526 opposite to the unfixed distal end 524, an inlet of a polymer solution 528, and an outlet of the polymer solution 530. The polymer solution is pumped into the tubular fiber spinning needle 522 of the at least one nozzle 502 through the inlet of the polymer solution 528 and the jet of compressed gas is directed into the hollow space of the nozzle 502 through the first inlet of the jet of compressed gas 520 to produce polymer fibers 532 at the unfixed distal end 524. The obtained polymer fibers 532 are collected on the air permeable fiber collection surface 508 by the suction unit 510 on the backside of the air permeable fiber collection surface 508 that produces a suction pressure in a direction opposite to the direction of the polymer fibers 532 produced at the unfixed distal end 524 so that the produced polymer fibers 532 are guided towards the air permeable fiber collection surface 508 and get deposited on the air permeable fiber collection surface 508. The first roller 512A, the second roller 512B and the third roller 512C enable movement of the air permeable fiber collection surface 508 in a direction perpendicular to the direction of the spinning of the at least one nozzle 502. The formed polymer fibers 532 are detached by the forces caused by growth and the vibration of the polymer fiber and the air flow from the unfixed distal end 524 and collected and deposited on the air permeable fiber collection surface 508 gets attached to each other on the air permeable fiber collection surface 508 and form the polymer fiber material 534 which gets collected on the wind- up roller 512D. The jet of compressed gas is directed into the hollow space of the nozzle 502, wherein the jet of compressed gas additionally guides the produced polymer fibers 532 towards the air permeable fiber collection surface 508.

Figure 6:
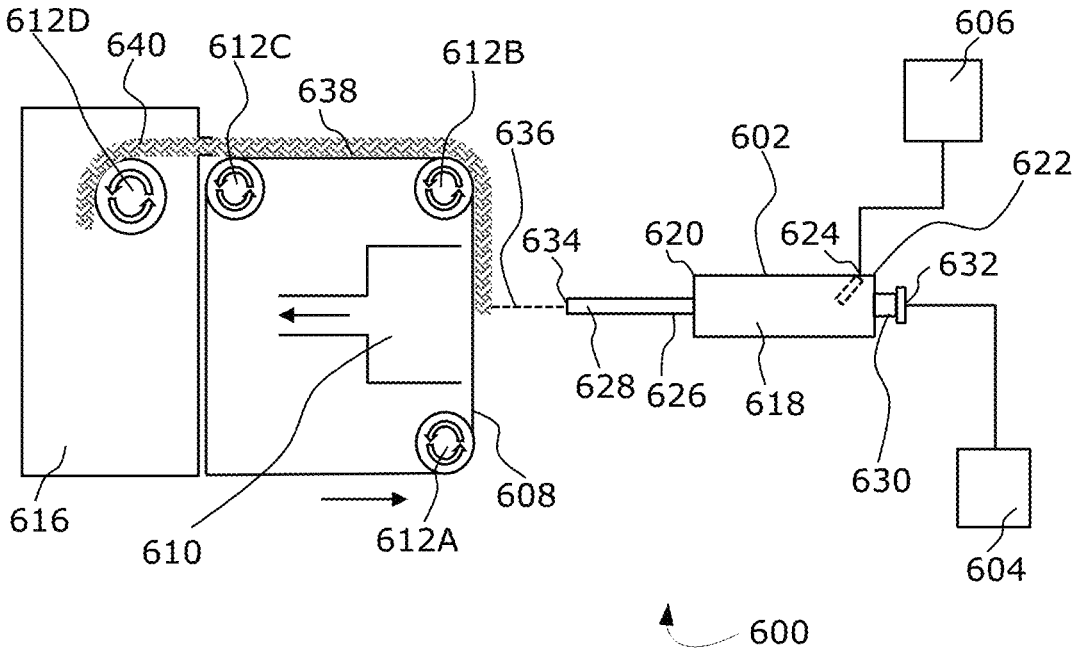
FIG. 6 is a schematic illustration of a device with a heating unit and a solvent evaporation chamber for producing a polymer fiber material in accordance with an embodiment of the present disclosure.

FIG. 6 is a schematic illustration of a device 600 with a heating and a solvent evaporation chamber 616 for producing a polymer fiber material 640 according to an embodiment of the present disclosure. The device 600 includes at least one nozzle 602, a pump 604 to pump a polymer solution, a gas compressor 606 to direct a jet of compressed gas, an air permeable fiber collection surface 608, a suction unit 610, a first roller 612A, a second roller 612B, a third roller 612C and a wind-up roller 612D and the heating and the solvent evaporation chamber 616. The at least one nozzle 602 includes a body 618 having a hollow space, an opened first end 620, a second end 622 opposite to the opened first end 620, a first inlet of a jet of compressed gas 624 in the second end 622, and tubular fiber spinning needle 626. The tubular fiber spinning needle 626 includes an unfixed distal end 628, a proximal end 630 opposite to the unfixed distal end 628, an inlet of a polymer solution 632, and an outlet of the polymer solution 634. The polymer solution is pumped by the pump 604 into tubular fiber spinning needle 626 of the nozzle 602 through the inlet of the polymer solution 632 and the jet of compressed gas is directed into the hollow space of the nozzle 602 through the first inlet of the jet of compressed gas 624 to produce polymer fibers 636 at the unfixed distal end 628 of the tubular fiber spinning needle 626.

The obtained polymer fibers 636 are collected on the air permeable fiber collection surface 608 by the suction unit 610 on the backside of the air permeable fiber collection surface 608 that produces a suction pressure in a direction opposite with respect to the direction of the polymer fibers 636 produced at the unfixed distal end 628 so that the produced polymer fibers 636 are guided towards the air permeable fiber collection surface 608 and get deposited on the air permeable fiber collection surface 608. The first roller 612A, the second roller 612B and the a third roller 612C enable movement of the air permeable fiber collection surface 608 in a direction perpendicular to the direction of spinning of the at least one nozzle 602. The obtained polymer fibers 636 detached from the unfixed distal end 628 and collected and deposited on the air permeable fiber collection surface 608 get attached to each other on the air permeable fiber collection surface 608 and form the polymer fiber material 638. The polymer fiber material 638 on the air permeable fiber collection surface 608 is further passed through the heating and the solvent evaporation chamber 616 to evaporate the solvent more quickly and produce a polymer fiber material 640 that is free from the solvent and toxic chemicals. The polymer fiber material 640 free from the solvent and toxic chemicals is collected on wind-up roller 612D.

Figure 7:
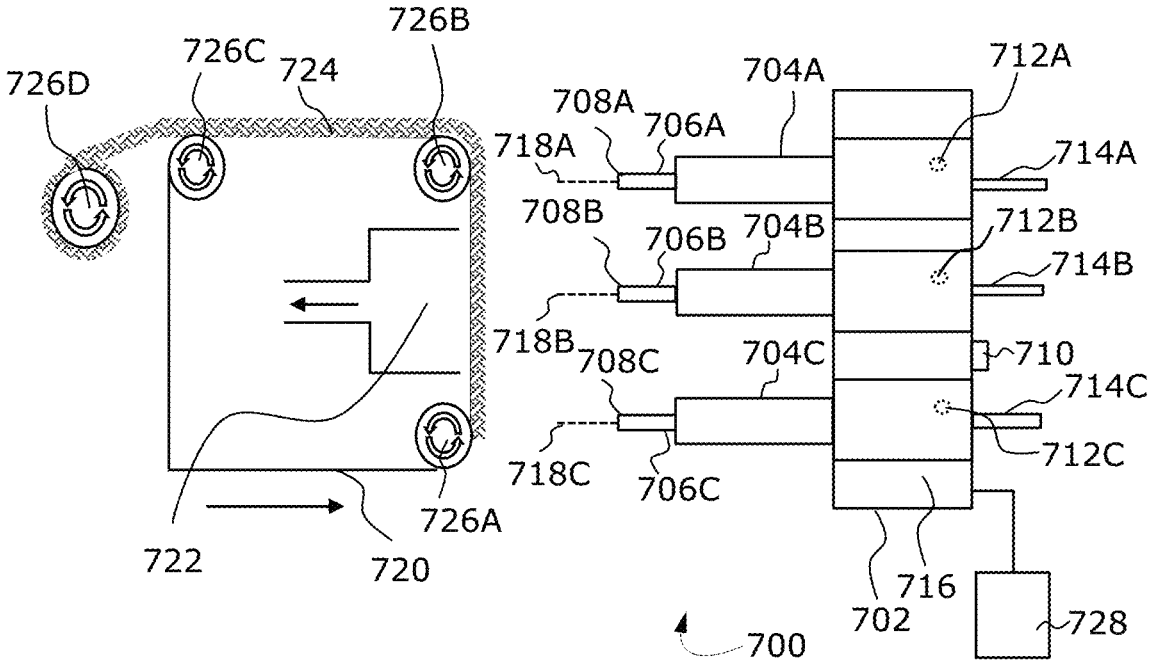
FIG. 7 is a schematic illustration of a device comprising a spinneret configured to produce polymer fibers in accordance with an embodiment of the present disclosure.

FIG. 7 is a schematic illustration of a device 700 that comprises a spinneret 702 for producing polymer fibers according to an embodiment of the present disclosure. The device 700 includes the spinneret 702 including a first cylindrical nozzle 704A, a second cylindrical nozzle 704B, a third cylindrical nozzle 704C attached to the spinneret 702, a second inlet of a jet of compressed gas 710 to the spinneret 702, an air permeable fiber collection surface 720, a suction unit 722, a first roller 726A, a second roller 726B, a third roller 726C, a wind-up roller 726D. The each of the cylindrical nozzles 704A, 704B, 704C comprise a tubular fiber spinning needles correspondingly 706A, 706B, 706C and a first inlet of the jet of compressed air correspondingly 712A, 712B, 712C. Each of the tubular fiber spinning needles 706A, 706B, 706C includes an inlet of a polymer solution 714A, 714B, 714C and an unfixed distal end 708A, 708B, 708C. The spinneret 702 includes a hollow body 716 to which the first cylindrical nozzle 704A, the second cylindrical nozzle 704B and the third cylindrical nozzle 704C are attached. The jet of compressed gas, e.g. air, is passed into the spinneret 702 through the second inlet of the jet of compressed gas 710. The jet of compressed gas is further directed through the second inlet of the jet of compressed gas 710 to each of the cylindrical nozzles 704A, 704B, 704C through the first inlet of the jet of compressed gas 712A, 712B, 712C and the polymer solution is directed into the first cylindrical nozzle 704A, the second cylindrical nozzle 704B and the third cylindrical nozzle 704C through the inlets of a polymer solution 714A, 714B, 714C respectively to produce polymer fibers 718A, 718B, 718C at the unfixed distal ends 708A, 708B, 708C of the tubular fiber spinning needles 706A, 706B, 706C. The polymer fibers 718A, 718B, 718C are collected on the air permeable fiber collection surface 720 by the suction unit 722 on the backside of the air permeable fiber collection surface 720 that produces a suction pressure in a direction opposite to the direction of the polymer fibers 718A, 718B, 718C produced at the unfixed distal end 708A, 708B, 708C of the tubular fiber spinning needles 706A, 706B, 706C so that the produced polymer fibers 718A, 718B, 718C are guided towards the air permeable fiber collection surface 720 and get deposited on the air permeable fiber collection surface 720. The first roller 726A, the second roller 726B and the third roller 726C are configured to move the air permeable fiber collection surface 720 in a direction perpendicular to the direction of spinning of the spinneret 702. The obtained polymer fibers 718A, 718B, 718C detached from the unfixed distal end 708A, 708B, 708C and collected and deposited on the air permeable fiber collection surface become attached to each other on the air permeable fiber collection surface 720 to form a polymer fiber material 724. The polymer fiber material 724 is collected on wind-up roller 726D. The second moving means 728 of the spinneret 702 is configured to move the spinneret 702 in at least one of a left and right, up and down directions to provide additional movement to the spinneret 702 to achieve a higher and more homogenous density of the deposited polymer fibers and thus to enable to obtain different properties of the polymer fiber material.

Figure 8A:
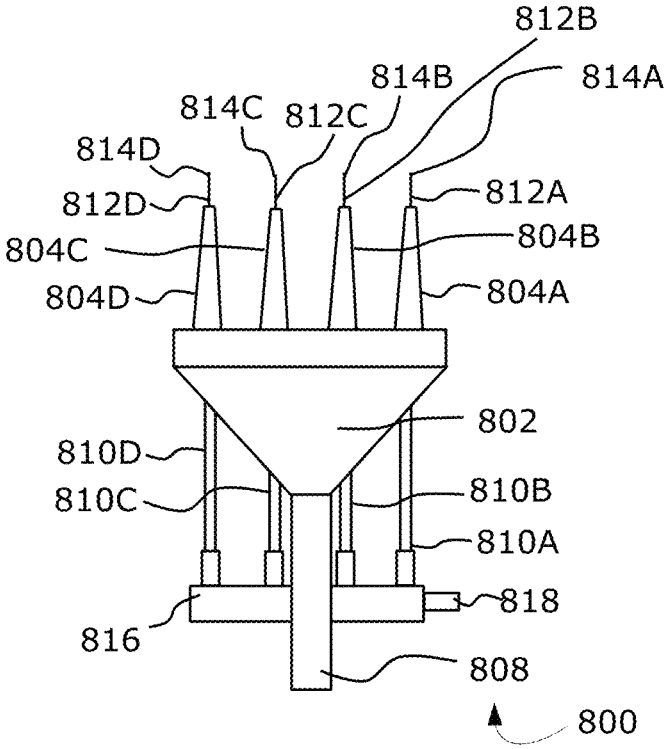
FIG. 8A is a schematic illustration of a spinneret configured to produce polymer fibers according to an embodiment of the present disclosure.

FIG. 8A is a schematic illustration of a spinneret 800 configured to produce polymer fibers according to an embodiment of the present disclosure. The spinneret 800 having triangular shape includes a hollow body 802, a first conical nozzle 804A, a second conical nozzle 804B, a third conical nozzle 804C and a fourth conical nozzle 804D protruding from the top of the hollow body 802, a second inlet of a jet of compressed gas 808, a second inlet of a polymer solution 818. Each of the conical nozzles 804A, 804B, 804C, 804D includes a tubular fiber spinning needles 812A, 812B, 812C, 812D having inlets of the polymer solution correspondingly 810A, 810B, 810C and 810D. The polymer solution is pumped into the tubular fiber spinning needles 812A, 812B, 812C, 812D through the corresponding inlets of the polymer solution 810A, 810B, 810C, 810D. The inlets of the polymer solution 810A, 810B, 810C, 810D are arranged on an inlet housing 816. The inlet housing 816 is configured to receive the polymer solution from the second inlet of polymer solution 818 and further configured to direct the polymer solution into the inlets of the polymer solution 810A, 810B, 810C, 810D. Each of the tubular fiber spinning needles 812A, 812B, 812C, 812D comprise an unfixed distal end 814A, 814B, 814C, 814D. The jet of compressed gas is directed into the hollow body 802 of the spinneret 800 through the second inlet of the jet of compressed gas 808 and the polymer solution is directed into the inlets of the polymer solution 810A, 810B, 810C, 810D for producing the polymer fibers. The functions of these parts have been as described above.

Figure 8B:
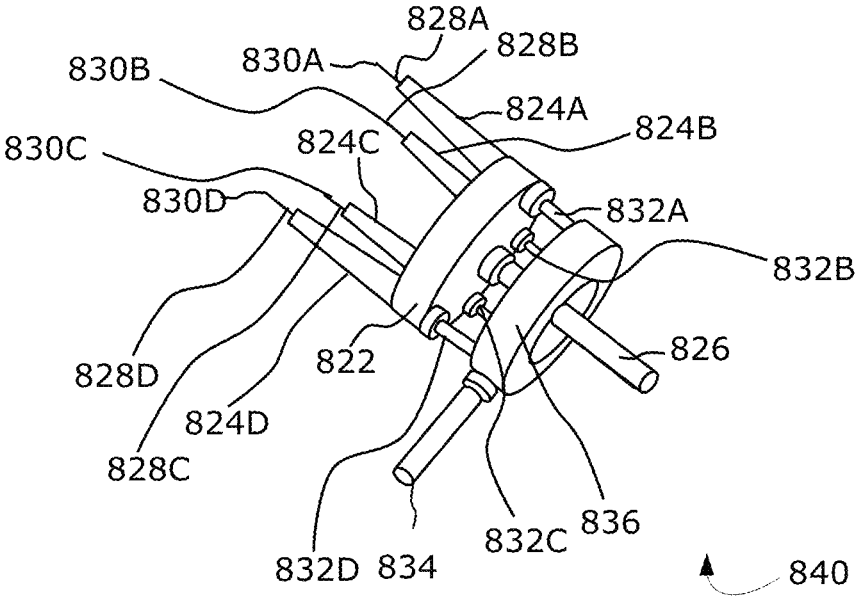
FIG. 8B is a schematic illustration of a spinneret configured to produce polymer fibers according to an embodiment of the present disclosure.

FIG. 8B is a schematic illustration of a spinneret 840 configured to produce polymer fibers according to an embodiment of the present disclosure. The spinneret 840 having a circular shape comprises a hollow body 822, a first conical nozzle 824A, a second conical nozzle 824B, a third conical nozzle 824C and a fourth conical nozzle 824D connected to the hollow body 822, a second inlet of a jet of compressed gas 826 and a second inlet of a polymer solution 834. Each of the conical nozzles 824A, 824B, 824C, 824D includes a tubular fiber spinning needles, correspondingly 828A, 828B, 828C, 828D, wherein each of the tubular fiber spinning needles inlets of the polymer solution, correspondingly 832A, 832B, 832C, 832D. The polymer solution is pumped into the tubular fiber spinning needles 828A, 828B, 828C, and 828D through the corresponding inlets of the polymer solution 832A, 832B, 832C, 832D. The inlets of the polymer solution 832A, 832B, 832C, 832D are arranged on an inlet housing 836. The inlet housing 836 is configured to receive the polymer solution from the second inlet of polymer solution 834 and further configured to direct the polymer solution into the inlets of the polymer solution 832A, 832B, 832C, 832D. The at least one tubular fiber spinning needle 828A, 828B, 828C, 828D includes an unfixed distal end 830A, 830B, 830C, 830D. The jet of compressed gas is directed into the hollow body 822 of the circular spinneret 840 through the second inlet of the jet of compressed gas 826 and the polymer solution is directed into the inlet of the polymer solution 832A, 832B, 832C, 832D for producing the polymer fibers. The functions of these parts have been as described above.

Figure 9:
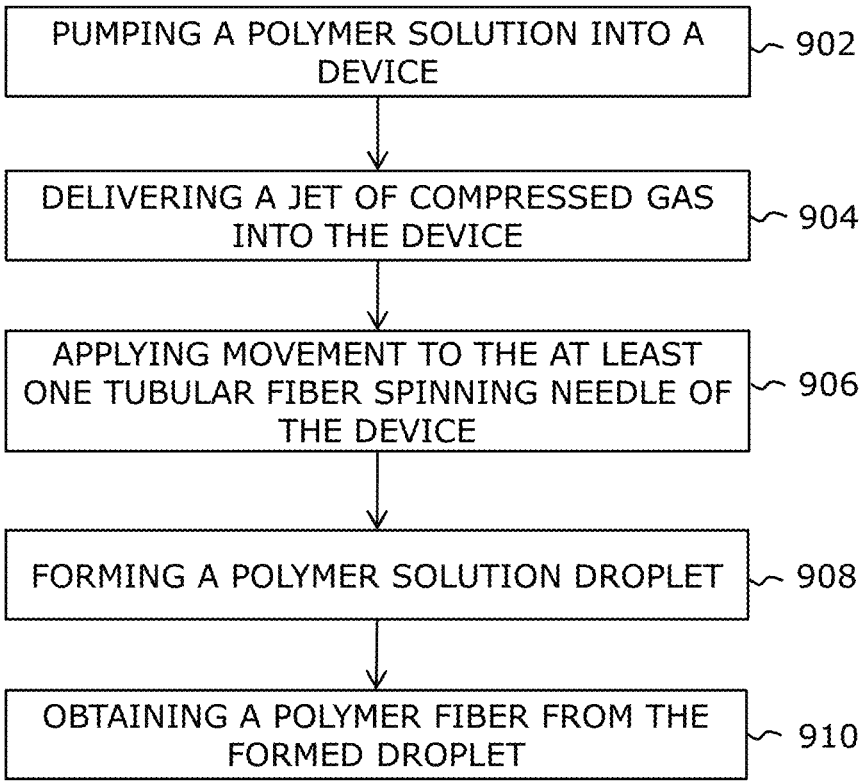
FIG. 9 is a flowchart illustrating a method for producing polymer fibers in accordance with an embodiment of the present disclosure.

FIG. 9 is a flowchart illustrating a method for producing polymer fibers according to an embodiment of the present disclosure. At step 902, a polymer solution is pumped from the polymer solution pump into at least one nozzle comprising tubular fiber spinning needle of a device through an inlet of the polymer solution of the tubular fiber spinning needle. At step 904, a jet of compressed gas is delivered by the gas compressor into the at least one nozzle through a first inlet of compressed gas. At step 906, a movement is applied to the at least one tubular fiber spinning needle by the jet of compressed gas. At step 908, a droplet is formed to a tip of a distal end of the at least one tubular fiber spinning needle. At step 910, a polymer fiber from the formed droplet is obtained. In an embodiment, a diameter of the polymer fiber is 0.2-10 micrometers.

Figure 10:
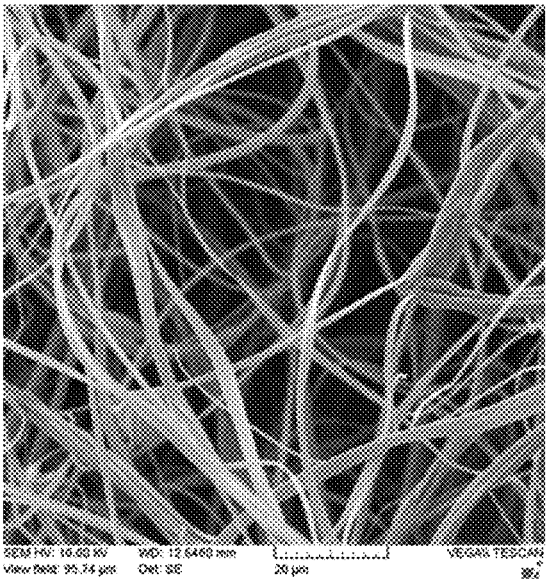
FIG. 10 is an illustration of the morphology of the polymer fibers according to the present disclosure.

FIG. 10 is an illustration of the morphology of the polymer fibers according to the present disclosure, wherein an image of polymer fibers obtained from gelatin solution according to the present disclosure is shown. The gelatin fibers were analysed by scanning electron microscopy (SEM) device VEGA Tescan and tensile strength testing, wherein the SEM analysis parameters were as follows: Accelerating voltage (HV) 10.00 kV; working distance (WD) 12.6480 mm; View field 95.74 micrometers; Detector: Secondary electrons (SE). The results of the SEM analyses demonstrated the nanofibrous nature of the material and the twisted ribbon type morphology of the individual fibers. The tensile strength testing showed the material's superior mechanical properties to known spinning technologies.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A device for producing polymer fibers, the device comprising:

at least one nozzle configured to receive a polymer solution and a jet of compressed gas, wherein the at least one nozzle comprises:

a body having a hollow space, an opened first end and a second end opposite to the opened first end, a first inlet of the jet of compressed gas in the second end, and at least one tubular fiber spinning needle mounted through the second end and the hollow space, wherein the at least one tubular fiber spinning needle comprises:

an unfixed distal end protruding from the opened first end a proximal end opposite to the unfixed distal end, an inlet of the polymer solution at the proximal end, and an outlet of the polymer solution at the unfixed distal end, wherein the proximal end of the at least one tubular fiber spinning needle is fixed to the second end of the at least one nozzle, wherein the first inlet of the jet of compressed gas is formed offset from a nozzle axis of the at least one nozzle so that the jet of compressed gas creates a rotating vortex in the hollow space, which causes the unfixed distal end of the at least one tubular fiber spinning needle to revolve or vibrate;

a pump configured to pump the polymer solution through the at least one tubular fiber spinning needle of the at least one nozzle; and a gas compressor configured to direct the jet of compressed gas into the first inlet of the jet of compressed gas of the at least one nozzle.

2. The device according to claim 1, wherein the device further comprises two or more nozzles and a spinneret comprising a hollow body having a second inlet of the jet of compressed gas, wherein the two or more nozzles are connected to the hollow body by the second end and wherein the gas compressor is configured to direct the jet of compressed gas into the hollow body of the spinneret through the second inlet of the jet of compressed gas and through the hollow body to the first inlet of the jet of compressed gas of the each nozzle of two or more nozzles.

3. The device according to claim 1, wherein the first moving means of the unfixed distal end of the at least one tubular fiber spinning needle is selected from a group comprising a mechanical or electromechanical device moving the unfixed distal end of the at least one tubular fiber spinning needle, a mechanical or electromechanical device vibrating the at least one nozzle and the first moving means formed by the first inlet of the jet of compressed gas in the second end of the at least one nozzle.

4. The device according to claim 2, wherein the first moving means of the unfixed distal end of the at least one tubular fiber spinning needle is selected from a group comprising a mechanical or electromechanical device moving the unfixed distal end of the at least one tubular fiber spinning needle, a mechanical or electromechanical device vibrating the at least one nozzle and the first moving means formed by the first inlet of the jet of compressed gas in the second end of the at least one nozzle.

5. The device according to claim 1, wherein the device further comprises a collection unit for collecting the polymer fibers, wherein the collection unit comprises an air permeable fiber collection surface and a suction unit configured to draw an air through the air permeable fiber collection surface and to produce a suction pressure for depositing the polymer fibers on the air permeable fiber collection surface.

6. The device according to claim 5, wherein the air permeable fiber collection surface further comprises an air permeable fiber collection material.

7. The device according to claim 5, wherein the collection unit further comprises a heating and solvent evaporation chamber and the air permeable fiber collection surface is a movable air permeable fiber collection surface.

8. The device according to claim 1, wherein a diameter of the at least one nozzle is 1.5 mm-5.0 mm and a diameter of the at least one tubular fiber spinning needle is 0.6 mm-1.6 mm.

9. The device according to claim 1, wherein the device further comprises a moving means of the at least one nozzle to apply at least one movement to the at least one nozzle, and wherein the at least one movement is selected from rotating the at least one nozzle, moving the at least one nozzle left and right, and moving the at least one nozzle up and down with respect to the air permeable fiber collection surface.

10. The device according to claim 1, wherein the device further comprises a compressed gas heating unit.

11. The device according to claim 1, wherein the hollow space is an axially symmetric hollow space.

* * * * *